US011180856B1

(12) United States Patent
Obot et al.

(10) Patent No.: US 11,180,856 B1
(45) Date of Patent: Nov. 23, 2021

(54) CORROSION INHIBITOR COMPOSITION AND METHODS OF INHIBITING CORROSION

(71) Applicants: KING FAHD UNIVERSITY OF PETROLEUM AND MINERALS, Dhahran (SA); Saline Water Conversion Corporation, Jubail (SA)

(72) Inventors: Ime Bassey Obot, Dhahran (SA); Abdelkader Meroufel, Jubail (SA); Ahmad A. Sorour, Dhahran (SA); Ikenna B. Onyeachu, Dhahran (SA); Saviour A. Umoren, Dhahran (SA); Abdulrhaman Faleh Alenazi, Jubail (SA); Moses M. Solomon, Dhahran (SA)

(73) Assignees: KING FAHD UNIVERSITY OF PETROLEUM AND MINERALS, Dhahran (SA); Saline Water Conversion Corporation, Jubail (SA)

( * ) Notice: Subject to any disclaimer, the term of this patent is extended or adjusted under 35 U.S.C. 154(b) by 0 days.

(21) Appl. No.: 16/904,904

(22) Filed: Jun. 18, 2020

(51) Int. Cl.

| | |
|---|---|
| ***C23F 11/14*** | (2006.01) |
| ***C23F 11/18*** | (2006.01) |
| ***C23F 11/12*** | (2006.01) |
| ***C23F 11/16*** | (2006.01) |

(52) U.S. Cl.
CPC ..... *C23F 11/149* (2013.01); *C23F 11/122* (2013.01); *C23F 11/16* (2013.01); *C23F 11/185* (2013.01)

(58) Field of Classification Search
CPC ..... C23F 11/12
See application file for complete search history.

(56) References Cited

U.S. PATENT DOCUMENTS

| | | | |
|---|---|---|---|
| 10,392,711 | B2 | 8/2019 | Alkhaldi et al. |
| 2020/0002820 | A1 | 1/2020 | Al-Marzouqi et al. |

FOREIGN PATENT DOCUMENTS

| | | | |
|---|---|---|---|
| CN | 103510094 | A | 1/2014 |
| CN | 110468421 | A | 11/2019 |
| IN | 201406278 | I4 | 10/2015 |

OTHER PUBLICATIONS

Saviour A. Umoren, et al., "Comparative studies on the corrosion inhibition efficacy of ethanolic extracts of date palm leaves and seeds on carbon steel corrosion in 15% HCl solution", Journal of Adhesion Science and Technology, vol. 32, No. 17, 2018, pp. 1934-1951.

(Continued)

*Primary Examiner* — Peter F Godenschwager
(74) *Attorney, Agent, or Firm* — Oblon, McClelland, Maier & Neustadt, L.L.P.

(57) ABSTRACT

A corrosion inhibitor composition, which includes (i) a date palm leaves extract, (ii) a benzimidazole compound having at least one a carbamate group, (iii) a pyridine compound, (iv) a thiourea compound, (v) a cinnamaldehyde compound, (vi) a metal iodide, (vii) urotropin, and (viii) a base fluid containing an alcohol and an organic acid. A method of inhibiting corrosion of metal during acid cleaning is also disclosed, whereby the metal is treated with an acidic treatment fluid containing 1 to 5 wt. % of an acid, based on a total weight of the acidic treatment fluid, and 0.1 to 5 vol. % of the corrosion inhibitor composition, based on a total volume of the acidic treatment fluid.

20 Claims, 4 Drawing Sheets

(56) References Cited

OTHER PUBLICATIONS

Wen-cheng Ding, et al., "Corrosion Inhibition Performance of Derivative of Nicotinic Acid for Q235 Carbon Steel in Hydrochloric Acid", Materials Protection, www.cnki.com.cn, May 2012, 1 page (Abstract only).

I. Ahamad, et al., "Electrochemical and Quantum Chemical Study of Albendazole as Corrosion Inhibitor for Mild Steel in Hydrochloric Acid Solution", International Journal of Electrochemical Science, vol. 7, Apr. 1, 2012, pp. 3436-3452.

Seyyed Ali Mard, et al., "Evaluation of the Antidiabetic and Antilipaemic Activities of the Hydroalcoholic Extract of *Phoenix dactylifera* Palm Leaves and Its Fractions in Alloxan-Induced Diabetic Rats", Malaysian J Med Sci., vol. 17, No. 4. Oct.-Dec. 2010, pp. 4-13.

Hajira A. Qadoos, et al., "Phenolic content and antimicrobial activities of date palm (*Phoenix dactylifera* L.) fruits and leaves", Food Biology, vol. 6, Apr. 12, 2017, pp. 11-15.

CORROSION INHIBITOR COMPOSITION AND METHODS OF INHIBITING CORROSION

BACKGROUND OF THE INVENTION

Field of the Invention

The present invention relates to a corrosion inhibitor composition and methods of inhibiting corrosion during acid cleaning.

Discussion of the Background

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly nor impliedly admitted as prior art against the present invention.

In many production plants, cooling water systems, and desalination plants, during operation inorganic deposits (scale) as well as oily deposits may form on various surfaces such as those found in heat exchanger tubes and condensers, and lead to a reduction in the efficiency of heat transfer. See M. R. Malayeri, M. R. Jalalirad, Mitigation of crystallization scale in a single heated tube using projectiles of different sizes and hardness, Heat Transfer Eng. 35 (2014) 1418-1426, incorporated herein by reference in its entirety. This scaling phenomenon may affect fluid flow, cause corrosion beneath the deposit, and may shorten the lifespan of the equipment, all of which may increase operational costs and/or require shutting down the plant. See W. W. Frenier, 20 years of advances in technology for chemically cleaning industrial equipment: A critical review, NACE 338, NACE International Conference, 22-27 Mar. 1998, San Diego, Calif., USA, incorporated herein by reference in its entirety. Acid cleaning is, therefore, an important practice for the removal of these inorganic scales.

Typically, hydrochloric acid (HCl), sulfuric acid ($H_2SO_4$), and/or sulfamic ($NH_3SO_3$) acids are used for this purpose. However, HCl is the most efficient acid for acid cleaning because it usually forms soluble products when it reacts with and/or dissolves the inorganic compounds. Despite the capability to descale, acids are well-known corrosion causing agents of metal surfaces. Consequently, corrosion inhibitors are often added to combat corrosion caused by the acid cleaning solutions.

One challenge in developing effective corrosion inhibitors for acid cleaning applications involving industrial equipment such as heat exchangers and condenser tubes is the fact that industrial equipment is composed of different types of alloys which have different corrosion behaviors. Typical alloys for construction of heat exchanger tubes are carbon steel, austenitic cast iron (Ni-Resist) and stainless steel. Additionally, it has proven difficult to formulate effective corrosion inhibitors that are also environmentally benign.

In 1935, Grebe was granted the first patent for developing an acid cleaning corrosion inhibitor based on gelatin, saponin, gum Arabic and licorice. See J. J. Grebe, Treatment of wells, U.S. Pat. No. 1,989,479 (Issued Jan. 29, 1935), incorporated herein by reference in its entirety. These active components contain unsaturated organic compounds containing electronegative elements such as oxygen, nitrogen, and sulfur. The unsaturated bonds and the lone pair of electrons on the electronegative elements ensure inhibitor-metal interaction. This facilitates the formation of a hydrophobic film, which isolates the metal surface from attack by the acid solution. See W. W. Frenier, F. B. Growcock, Inhibitors for Chemical Cleaning Applications, in Reviews on Corrosion Science and Technology, Raman, A. and Labine, P., eds., (Houston, Tex.: NACE International, 1993); W. C. Kennedy, Corrosion inhibitors for cleaning solutions, U.S. Pat. No. 4,637,899 (1987); and I. B. Obot, I. B. Onyeachu, N. Wazzan, A. H. Al-Amri, Theoretical and experimental investigation of two alkyl carboxylates as corrosion inhibitor for steel in acidic medium, J. Mol. Liq. 279 (2019) 190-207, each incorporated herein by reference in their entirety.

Acid cleaning corrosion inhibitors for ferrous-based alloys have also been formulated by several other inventors, some of which are based on protein-derived or sugar-derived polymers, quaternary ammonium compounds, and organic acids derived from sugars, etc. See U.S. Pat. Nos. 4,851,149; 6,540,943; and 7,828,908 B1, each incorporated herein by reference in their entirety. Most of the currently used commercial acid cleaning corrosion inhibitors contain alkynyl alcohols, such as propargyl alcohol, which pose serious toxicity to aquatic species. In addition to toxicity, many corrosion inhibitor formulations suffer from manufacturing complexity, the requirement for application under static conditions, and overall expense.

In view of the forgoing, there is a need for effective, low cost, and environmentally friendly corrosion inhibitors that can be used for preventing corrosion of ferrous metal alloys during acid cleaning operations.

SUMMARY OF THE INVENTION

Accordingly, it is one object of the present invention to provide a corrosion inhibitor composition that includes: (i) a date palm leaves extract, (ii) a benzimidazole compound having at least one a carbamate group, (iii) a pyridine compound, (iv) a thiourea compound, (v) a cinnamaldehyde compound, (vi) a metal iodide, (vii) urotropin, and (viii) a base fluid containing an alcohol and an organic acid.

In some embodiments, the date palm leaves extract is an ethanolic date palm leaves extract.

In some embodiments, the ethanolic date palm leaves extract has a total phenolic content of 65 to 74 mg per g of the ethanolic date palm leaves extract, as determined by Folin-Ciocalteu assay.

In some embodiments, the date palm leaves extract is present in an amount of 0.1 to 10 wt. %, based on a total weight of the corrosion inhibitor composition.

In some embodiments, the benzimidazole compound is of formula (I) or a tautomer thereof (I)

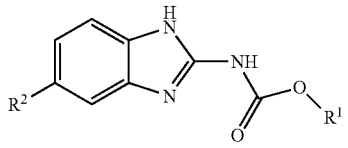

wherein:

$R^1$ is a an optionally substituted alkyl, an optionally substituted aryl, an optionally substituted arylalkyl, or an optionally substituted heterocyclyl; and $R^2$ is a hydrogen, an optionally substituted alkyl, an optionally substituted aryl, an optionally substituted arylalkyl, an optionally substituted heterocyclyl, an optionally substituted amide, a mercapto, an optionally substituted alkylthio, an optionally substituted arylthio, an optionally substituted alkoxy, a hydroxyl, a carboxy, a halo, an optionally substituted alkanoyloxy, an optionally substituted alkoxycarbonyl, an optionally substituted aroyl, or an optionally substituted alkanoylamino.

In some embodiments, the benzimidazole compound is present in an amount of 0.1 to 8 wt. %, based on a total weight of the corrosion inhibitor composition.

In some embodiments, the benzimidazole compound is present in an amount of 1 to 2 wt. %, based on a total weight of the corrosion inhibitor composition.

In some embodiments, the pyridine compound is of formula (II)

(II)

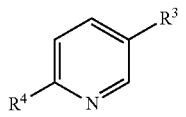

wherein:

$R^3$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, a halo, an optionally substituted alkoxycarbonyl, or an optionally substituted amino; and $R^4$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, an optionally substituted alkoxycarbonyl, or a formyl.

In some embodiments, the pyridine compound is present in an amount of 0.05 to 5 wt. %, based on a total weight of the corrosion inhibitor composition.

In some embodiments, the thiourea compound is of formula (III)

(III)

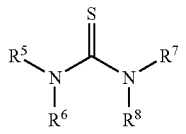

wherein:

$R^5$ and $R^7$ are independently a hydrogen, an optionally substituted alkyl, an optionally substituted aryl, or an optionally substituted arylalkyl, and $R^6$ and $R^8$ are independently a hydrogen, an optionally substituted alkyl, an optionally substituted aryl, or an optionally substituted arylalkyl, or wherein $R^6$ and $R^8$ together with the nitrogen atoms to which they are attached, form a 5- or 6-membered ring.

In some embodiments, the thiourea compound is present in an amount of 0.01 to 5 wt. %, based on a total weight of the corrosion inhibitor composition.

In some embodiments, the cinnamaldehyde compound is of formula (IV)

(IV)

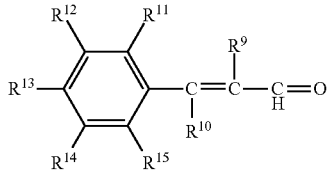

wherein:

$R^9$ and $R^{10}$ are independently hydrogen, an optionally substituted alkyl, an optionally substituted aryl, an optionally substituted alkoxy, or a halo, and $R^{11}$ to $R^{15}$ are independently hydrogen, an optionally substituted alkyl, an optionally substituted aryl, an optionally substituted alkoxy, an optionally substituted alkanoyl, an optionally substituted alkanoyloxy, a carboxy, an optionally substituted alkoxycarbonyl, a hydroxy, a halo, an optionally substituted amino, a nitro, a cyano, an optionally substituted alkylthio, or wherein two of these adjacent substituents represented by $R^{11}$, $R^{12}$, $R^{13}$, $R^{14}$ or $R^{15}$, together form a methylene dioxy group.

In some embodiments, the cinnamaldehyde compound is present in an amount of 0.001 to 2 wt. %, based on a total weight of the corrosion inhibitor composition.

In some embodiments, the metal iodide is sodium iodide, potassium iodide, or both.

In some embodiments, the metal iodide is present in an amount of 0.05 to 5 wt. %, based on a total weight of the corrosion inhibitor composition.

In some embodiments, the urotropin is present in an amount of 0.1 to 8 wt. %, based on a total weight of the corrosion inhibitor composition.

In some embodiments, the base fluid is present in an amount of 80 to 98 wt. %, based on a total weight of the corrosion inhibitor composition, and a weight ratio of the organic acid to the alcohol is 5:1 to 50:1.

It is another object of the present invention to provide a method of inhibiting corrosion of metal during acid cleaning, the method involving treating the metal with an acidic treatment fluid formulated with 1 to 5 wt. % of an acid, based on a total weight of the acidic treatment fluid, and 0.1 to 5 vol. % of the corrosion inhibitor composition, based on a total volume of the acidic treatment fluid.

In some embodiments, the metal is at least one ferrous metal selected from the group consisting of carbon steel, Ni-Resist, and stainless steel, and wherein the acid is at least one selected from the group consisting of hydrochloric acid, hydrofluoric acid, and sulfuric acid.

In some embodiments, the metal is treated with the acidic treatment fluid at a temperature of 40 to 70° C. to remove a buildup of scale on the metal.

BRIEF DESCRIPTION OF THE DRAWINGS

The foregoing paragraphs have been provided by way of general introduction, and are not intended to limit the scope of the following claims. A more complete appreciation of the invention and many of the attendant advantages thereof will be readily obtained as the same becomes better understood by reference to the following detailed description when considered in connection with the accompanying drawings, wherein:

DETAILED DESCRIPTION OF THE INVENTION

Figure 1:
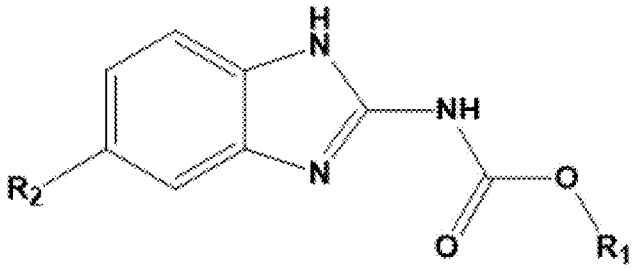
FIG. 1 illustrates a benzimidazole compound having a carbamate group on the 2-position.
Figure 2:
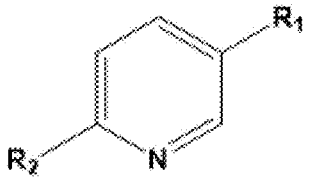
FIG. 2 illustrates a pyridine derivative.

In the following description, it is understood that other embodiments may be utilized and structural and operational changes may be made without departure from the scope of the present embodiments disclosed herein.

Definitions

Throughout the specification and the appended claims, a given chemical formula or name shall encompass all stereo and optical isomers and racemates thereof where such isomers exist. Unless otherwise indicated, all chiral (enantiomeric and diastereomeric) and racemic forms are within the scope of the disclosure. Many geometric isomers of C═C double bonds, C═N double bonds, ring systems, and the like can also be present in the compounds, and all such stable isomers are contemplated in the present disclosure. Cis- and trans- (or E- and Z-) geometric isomers of the compounds of the present disclosure are described and may be isolated as a mixture of isomers or as separated isomeric forms. The present compounds can be isolated in optically active or racemic forms. Optically active forms may be prepared by resolution of racemic forms or by synthesis from optically active starting materials. All processes used to prepare compounds of the present disclosure and intermediates made therein are considered to be part of the present disclosure. When enantiomeric or diastereomeric products are prepared, they may be separated by conventional methods, for example, by chromatography, fractional crystallization, or through the use of a chiral agent. Depending on the process conditions the end products of the present disclosure are obtained either in free (neutral) or salt form. Both the free form and the salts of these end products are within the scope of the disclosure. If so desired, one form of a compound may be converted into another form. A free base or acid may be converted into a salt; a salt may be converted into the free compound or another salt; a mixture of isomeric compounds of the present disclosure may be separated into the individual isomers. Compounds of the present disclosure, free form and salts thereof, may exist in multiple tautomeric forms, in which hydrogen atoms are transposed to other parts of the molecules and the chemical bonds between the atoms of the molecules are consequently rearranged. It should be understood that all tautomeric forms, insofar as they may exist, are included within the disclosure. Further, a given chemical formula or name shall encompass all conformers, rotamers, or conformational isomers thereof where such isomers exist. Different conformations can have different energies, can usually interconvert, and are very rarely isolatable. There are some molecules that can be isolated in several conformations. For example, atropisomers are isomers resulting from hindered rotation about single bonds where the steric strain barrier to rotation is high enough to allow for the isolation of the conformers. It should be understood that all conformers, rotamers, or conformational isomer forms, insofar as they may exist, are included within the present disclosure.

As used herein, the term "solvate" refers to a physical association of a compound of this disclosure with one or more solvent molecules, whether organic or inorganic. This physical association includes hydrogen bonding. In certain instances, the solvate will be capable of isolation, for example when one or more solvent molecules are incorporated in the crystal lattice of the crystalline solid. The solvent molecules in the solvate may be present in a regular arrangement and/or a non-ordered arrangement. The solvate may comprise either a stoichiometric or nonstoichiometric amount of the solvent molecules. Solvate encompasses both solution phase and isolable solvates. Exemplary solvents include, but are not limited to, water, methanol, ethanol, n-propanol, isopropanol, n-butanol, isobutanol, tert-butanol, ethyl acetate and other lower alkanols, glycerine, acetone, dichloromethane (DCM), dimethyl sulfoxide (DMSO), dimethyl acetate (DMA), dimethylformamide (DMF), isopropyl ether, acetonitrile, toluene, N-methylpyrrolidone (NMP), tetrahydrofuran (THF), tetrahydropyran, other cyclic mono-, di- and tri-ethers, polyalkylene glycols (e.g., polyethylene glycol, polypropylene glycol, propylene glycol), and mixtures thereof in suitable proportions. Exemplary solvates include, but are not limited to, hydrates, ethanolates, methanolates, isopropanolates and mixtures thereof. Methods of solvation are generally known to those of ordinary skill in the art.

As used herein, the term "fatty" describes a compound with a long-chain (linear) hydrophobic portion made up of hydrogen and anywhere from 6 to 26, 8 to 24, 10 to 22, 12 to 20, 14 to 18 carbon atoms, which may be fully saturated or partially unsaturated, and optionally attached to a polar functional group such as a hydroxyl group, an amine group, or a carboxyl group (e.g., carboxylic acid). Fatty alcohols, fatty amines, fatty acids, fatty esters, and fatty amides are examples of materials which contain a fatty portion, and are thus considered "fatty" compounds herein.

As used herein, "alkoxylated" or "alkoxylate" refers to compounds containing a (poly)ether group (i.e., (poly)oxyalkylene group) derived from reaction with, oligomerization of, or polymerization of one or more alkylene oxides having 2 to 4 carbon atoms, and specifically includes (poly)oxyethylene (derived from ethylene oxide, EO), (poly)oxypropylene (derived from propylene oxide, PO), and (poly) oxybutylene (derived from butylene oxide, BO), as well as mixtures thereof.

The phrase "substantially free", unless otherwise specified, describes a particular component being present in an amount of less than about 1 wt. %, preferably less than about 0.5 wt. %, more preferably less than about 0.1 wt. %, even more preferably less than about 0.05 wt. %, yet even more preferably 0 wt. %, relative to a total weight of the composition being discussed.

As used herein, the terms "optional" or "optionally" means that the subsequently described event(s) can or cannot occur or the subsequently described component(s) may or may not be present (e.g., 0 wt. %).

The term "alkyl", as used herein, unless otherwise specified, refers to a straight, branched, or cyclic, aliphatic fragment having 1 to 26 carbon atoms, preferably 2 to 24, preferably 3 to 22, preferably 4 to 20, preferably 5 to 18, preferably 6 to 16, preferably 7 to 14, preferably 8 to 12, preferably 9 to 10. Non-limiting examples include, but are not limited to, methyl, ethyl, propyl, isopropyl, butyl, isobutyl, t-butyl, pentyl, isopentyl, neopentyl, hexyl, isohexyl, 3-methylpentyl, 2,2-dimethylbutyl, 2,3-dimethylbutyl, lauryl, myristyl, cetyl, stearyl, and the like, including guerbet-type alkyl groups (e.g., 2-methylpentyl, 2-ethylhexyl, 2-proylheptyl, 2-butyloctyl, 2-pentylnonyl, 2-hexyldecyl, 2-heptylundecyl, 2-octyldodecyl, 2-nonyltridecyl, 2-decyltetradecyl, and 2-undecylpentadecyl), and unsaturated alkenyl and alkynyl variants such as vinyl, allyl, 1-propenyl, 2-propenyl, 1-butenyl, 2-butenyl, 3-butenyl, 1-pentenyl, 2-pentenyl, 3-pentenyl, 4-pentenyl, 1-hexenyl, 2-hexenyl, 3-hexenyl, 4-hexenyl, 5-hexenyl, oleyl, linoleyl, and the like. Cycloalkyl is a specific type (cyclic) of alkyl group. Exemplary cycloalkyl groups include, but are not limited to, cyclopropyl, cyclobutyl, cyclopentyl, cyclohexyl, norbornyl, and adamantyl. The term "lower alkyl" is used herein to describe alkyl groups having 1 to 5 carbon atoms (e.g., methyl, ethyl, n-propyl, etc.).

The term "aryl" means a carbocyclic aromatic monocyclic group containing 6 carbon atoms which may be further fused to a second 5- or 6-membered carbocyclic group which may be aromatic, saturated or unsaturated. Aryl includes, but is not limited to, phenyl, anthracenyl, indanyl, 1-naphthyl, 2-naphthyl, and tetrahydronaphthyl. The fused aryls may be connected to another group either at a suitable position on the cycloalkyl/cycloalkenyl ring or the aromatic ring.

The term "arylalkyl", as used herein, refers to a straight or branched chain alkyl moiety (as defined above) that is substituted by an aryl group (as defined above), examples of which include, but are not limited to, benzyl, phenethyl, 2-methylbenzyl, 3-methylbenzyl, 4-methylbenzyl, 2,4-dimethylbenzyl, 2-(4-ethylphenyl)ethyl, 3-(3-propylphenyl)propyl, and the like.

The term "alkoxy" refers to an —O-alkyl group. Example alkoxy groups include, but are not limited to, methoxy, ethoxy, propoxy (e.g., n-propoxy and isopropoxy), and t-butoxy.

As used herein, the term "heterocycle" or "heterocyclyl" is intended to mean a stable 3-, 4-, 5-, 6-, or 7-membered monocyclic, 7-, 8-, 9-, 10-, or 11-membered bicyclic, or 7-, 8-, 9-, 10-, 11-, 12-, 13-, or 14-membered polycyclic heterocyclic ring that is saturated, partially unsaturated, or fully unsaturated, and that contains carbon atoms and 1, 2, 3 or 4 heteroatoms independently selected from the group consisting of N, O and S; and including any bicyclic or polycyclic group in which any of the above-defined heterocyclic rings is fused to a carbocyclic ring, the carbocyclic ring being either saturated, unsaturated, or aromatic (e.g., a benzene ring). The nitrogen and sulfur heteroatoms may optionally be oxidized (i.e., N→O and $S(O)_p$, wherein p is 0, 1 or 2). The nitrogen atom may be substituted or unsubstituted (i.e., N or NR wherein R is H or another substituent, if defined). The heterocyclic ring may be attached to its pendant group at any heteroatom or carbon atom that results in a stable structure. The heterocyclic rings described herein may be substituted on carbon or on a nitrogen atom if the resulting compound is stable. A nitrogen in the heterocycle may optionally be quaternized. It is preferred that when the total number of S and O atoms in the heterocycle exceeds 1, then these heteroatoms are not adjacent to one another. It is preferred that the total number of S and O atoms in the heterocycle is not more than 1. When the term "heterocycle" is used, it is intended to include "heteroaryl" (which will be defined below). Examples of heterocycles include, but are not limited to, acridinyl, azetidinyl, azocinyl, benzimidazolyl, benzofuranyl, benzothiofuranyl, benzothiophenyl, benzoxazolyl, benzoxazolinyl, benzthiazolyl, benztriazolyl, benztetrazolyl, benzisoxazolyl, benzisothiazolyl, benzimidazolinyl, carbazolyl, 4aH-carbazolyl, carbolinyl, chromanyl, chromenyl, cinnolinyl, decahydroquinolinyl, 2H,6H-1,5,2-dithiazinyl, dihydrofuro[2,3-b]tetrahydrofuran, furyl, furazanyl, imidazolidinyl, imidazolinyl, imidazolyl, 1H-indazolyl, imidazolopyridinyl, indolenyl, indolinyl, indolizinyl, indolyl (e.g., 1H-indolyl), isatinoyl, isobenzofuranyl, isochromanyl, isoindazolyl, isoindolinyl, isoindolyl, isoquinolinyl, isothiazolyl, isothiazolopyridinyl, isoxazolyl, isoxazolopyridinyl, methylenedioxyphenyl, morpholinyl, naphthyridinyl, octahydroisoquinolinyl, oxadiazolyl, 1,2,3-oxadiazolyl, 1,2,4-oxadiazolyl, 1,2,5-oxadiazolyl, 1,3,4-oxadiazolyl, oxazolidinyl, oxazolyl, oxazolopyridinyl, oxazolidinylperimidinyl, oxindolyl, pyrimidinyl, phenanthridinyl, phenanthrolinyl, phenazinyl, phenothiazinyl, phenoxathiinyl, phenoxazinyl, phthalazinyl, piperazinyl, homopiperazinyl, piperidinyl, piperidonyl, 4-piperidonyl, piperonyl, pteridinyl, purinyl, pyranyl, pyrazinyl, pyrazolidinyl, pyrazolinyl, pyrazolopyridinyl, pyrazolyl, pyridazinyl, pyridooxazolyl, pyridoimidazolyl, pyridothiazolyl, pyridinyl, pyrimidinyl, pyrrolidinyl, pyrrolinyl, 2-pyrrolidonyl, 2H-pyrrolyl, pyrrolyl, quinazolinyl, quinolinyl, 4H-quinolizinyl, quinoxalinyl, quinuclidinyl, tetrazolyl, tetrahydrofuranyl, tetrahydroisoquinolinyl, tetrahydroquinolinyl, 6H-1,2,5-thiadiazinyl, 1,2,3-thiadiazolyl, 1,2,4-thiadiazolyl, 1,2,5-thiadiazolyl, 1,3,4-thiadiazolyl, thianthrenyl, thiazolyl, thienyl, thiazolopyridinyl, thienothiazolyl, thienooxazolyl, thienoimidazolyl, thiophenyl, triazinyl, 1,2,3-triazolyl, 1,2,4-triazolyl, 1,2,5-triazolyl, 1,3,4-triazolyl, and xanthenyl. Also included are fused ring and spiro compounds containing, for example, the above heterocycles. Examples of 5- to 10-membered heterocycles include, but are not limited to, pyridinyl, thienyl, pyrrolyl, furyl, pyrazolyl, pyrazinyl, piperazinyl, piperidinyl, imidazolyl, imidazolidinyl, indolyl, tetrazolyl, isoxazolyl, morpholinyl, oxazolyl, oxadiazolyl, oxazolidinyl, tetrahydrofuranyl, thiadiazinyl, thiadiazolyl, thiazolyl, triazinyl, triazolyl, benzimidazolyl, IH-indazolyl, benzofuranyl, benzothiofuranyl, benztetrazolyl, benzo triazolyl, benzisoxazolyl, benzoxazolyl, oxindolyl, benzoxazolinyl, benzthiazolyl, benzisothiazolyl, isatinoyl, isoquinolinyl, octahydroisoquinolinyl, tetrahydroisoquinolinyl, tetrahydroquinolinyl, isoxazolopyridinyl, quinazolinyl, quinolinyl, isothiazolopyridinyl, thiazolopyridinyl, oxazolopyridinyl, imidazolopyridinyl, and pyrazolopyridinyl. Examples of 5- to 6-membered heterocycles include, but are not limited to, pyridinyl, furyl, thienyl, pyrrolyl, pyrazolyl, pyrazinyl, piperazinyl, piperidinyl, imidazolyl, imidazolidinyl, indolyl, tetrazolyl, isoxazolyl, morpholinyl, oxazolyl, oxadiazolyl, oxazolidinyl, tetrahydrofuranyl, thiadiazinyl, thiadiazolyl, thiazolyl, triazinyl, and triazolyl. Also included are fused ring and spiro compounds containing, for example, the above heterocycles. Examples of a bicyclic heterocyclic group include, but are not limited to, quinolinyl, isoquinolinyl, phthalazinyl, quinazolinyl, indolyl, isoindolyl, indolinyl, 1H-indazolyl, benzimidazolyl, 1,2,3,4-tetrahydroquinolinyl, 1,2,3,4-tetrahydroisoquinolinyl, 5,6,7,8-tetrahydro-quinolinyl, 2,3-dihydrobenzofuranyl, chromanyl, 1,2,3,4-tetrahydroquinoxalinyl, and 1,2,3,4-tetrahydro-quinazolinyl.

The term "heteroaryl" is intended to mean stable monocyclic and polycyclic aromatic hydrocarbons that include at least one heteroatom ring member such as sulfur, oxygen, or nitrogen. Heteroaryl groups are heterocyclyl groups which are aromatic, and may include, without limitation, pyridyl, pyrrolyl, pyrimidinyl, pyrazinyl, pyridazinyl, triazinyl, furyl, quinolyl, isoquinolyl, thienyl, imidazolyl, thiazolyl, indolyl (e.g., 1H-indolyl), pyrroyl, oxazolyl, benzofuryl, benzothienyl, benzthiazolyl, isoxazolyl, pyrazolyl, triazolyl, tetrazolyl, indazolyl (e.g., 1H-indazolyl), 1,2,4-thiadiazolyl, isothiazolyl, purinyl, carbazolyl, benzimidazolyl, indolinyl, benzodioxolanyl, and benzodioxane. Heteroaryl groups may be substituted or unsubstituted. The nitrogen atom may be substituted or unsubstituted (i.e., N or NR wherein R is H or another substituent, if defined). The nitrogen and sulfur heteroatoms may optionally be oxidized (i.e., N→O and $S(O)_p$, wherein p is 0, 1 or 2).

The term "halo" or "halogen" includes fluoro, chloro, bromo and iodo.

As used herein, "alkanoyloxy" groups are alkanoyl groups that are bound to oxygen (—O—C(O)-alkyl), for example, acetyloxy, propionyloxy, butyryloxy, isobutyryloxy, pivaloyloxy, valeryloxy, hexanoyloxy, octanoyloxy, lauroyloxy, and stearoyloxy. "Alkoxycarbonyl" substituents are alkoxy groups bound to C═O (e.g. —C(O)—Oalkyl), for example methyl ester, ethyl ester, and pivaloyl ester substitution where the carbonyl functionality is bound to the rest of the compound.

As used herein, the term "substituted" refers to at least one hydrogen atom that is replaced with a non-hydrogen group, provided that normal valencies are maintained and that the substitution results in a stable compound. When a substituent is noted as "optionally substituted", the substituent(s) are selected from alkyl, halo (e.g., chloro, bromo, iodo, fluoro), hydroxyl, alkoxy, oxo, alkanoyl, aroyl, aryloxy, alkanoyloxy, unsubstituted amino (—$NH_2$), substituted amino (e.g., alkylamino (—NHalkyl), cycloalkylamino (—NHcycloalkyl), arylamino (—NHaryl), arylalkylamino (—NHarylalkyl), disubstituted amino, e.g., in which the two amino substituents are selected from alkyl, aryl or arylalkyl, including substituted variants thereof, with specific mention being made to dimethylamino), alkanoylamino, aroylamino, arylalkanoylamino, thiol (mercapto), alkylthio, arylthio, arylalkylthio, alkylthiono, arylthiono, arylalkylthiono, alkyl sulfonyl, aryl sulfonyl, arylalkylsulfonyl, sulfonamide (e.g., —$SO_2NH_2$), substituted sulfonamide (e.g., —$SO_2$NHalkyl, —$SO_2$NHaryl, —$SO_2$NHarylalkyl, or cases where there are two substituents on one nitrogen selected from alkyl, aryl, or alkylalkyl), nitro, cyano, carboxy (carboxylic acid or carboxylate), unsubstituted amide (i.e. —$CONH_2$), substituted amide (e.g., —CONHalkyl, —CONHaryl, —CONHarylalkyl or cases where there are two substituents on one nitrogen selected from alkyl, aryl, or alkylalkyl), alkoxycarbonyl, aryl, guanidine, heterocyclyl (e.g., pyridyl, furyl, morpholinyl, pyrrolidinyl, piperazinyl, indolyl, imidazolyl, thienyl, thiazolyl, pyrrolidyl, pyrimidyl, piperidinyl, homopiperazinyl), and mixtures thereof. The substituents may themselves be optionally substituted, and may be either unprotected, or protected as necessary, as known to those skilled in the art, for example, as taught in Greene, et al., "Protective Groups in Organic Synthesis", John Wiley and Sons, Second Edition, 1991, hereby incorporated by reference in its entirety.

As used herein, "inhibit" means prevent, retard, slow, hinder, reverse, remove, lessen, reduce an amount of, or delay an undesirable process or an undesirable composition, or combinations thereof.

As used herein the term "corrosion inhibitor" refers to a substance(s) or composition that inhibits the deterioration of a metal surface by oxidation or other chemical reaction. Corrosive substances that can cause corrosion include water with high salt contents, acidic inorganic compounds such as hydrochloric acid, hydrofluoric acid, carbon dioxide ($CO_2$) and/or hydrogen sulfide ($H_2S$), organic acids, and microorganisms. Preferred corrosion inhibitors of the present invention inhibit the destructive effect such substances have on various metal surfaces.

"Scale" is a mineral salt deposit or coating formed on the surface of metal, rock or other material. Scale is caused by a precipitation due to a chemical reaction with the surface, precipitation caused by chemical reactions, a change in pressure or temperature, or a change in the composition of a solution. Exemplary scales include, but are not limited to, calcium carbonate, magnesium hydroxide, calcium sulfate, barium sulfate, strontium sulfate, iron sulfide, iron oxides, iron carbonate, the various silicates and phosphates and oxides, or any of a number of compounds insoluble or slightly soluble in water.

As used herein, the terms "scale inhibitor" or "antiscalant" refers to a substance(s) that inhibits the accumulation or buildup of unwanted scale (including reverses, cleans, removes, or otherwise reduces/lessens an amount of scale already existing on a surface), for example those surfaces exposed to brine-containing solutions during desalination processes.

Corrosion Inhibitor Composition

The present disclosure provides a corrosion inhibitor composition. The corrosion inhibitor composition of the present disclosure may be effective for inhibiting corrosion of various metals caused by acidic fluids, in particular, the corrosion of ferrous metals caused by acidic fluids used for the removal of scale from various process equipment, such as process equipment used in desalination operations where scale buildup is particularly problematic, as is the case in heat exchangers and utility steam condensers in multi-stage flash desalination plants.

The corrosion inhibitor composition disclosed herein generally comprises, consists essentially of, or consists of a date palm leaves extract, a benzimidazole compound having at least one a carbamate group, a pyridine compound, a thiourea compound, a cinnamaldehyde compound, a metal iodide, urotropin, and a base fluid comprising an alcohol and an organic acid.

Date Palm Leaves Extract

*Phoenix dactylifera* L., commonly known as date or date palm is a flowering plant species in the palm family, Arecaceae, cultivated for its edible sweet fruit known as a "date", which is a well-known staple food in North Africa, the Middle East and many other locations. By 2010, the Kingdom of Saudi Arabia contributed 14.4% of the global production of Date palm (approximately 1.078 million tons annually), making it the second largest producer in the world. See M. S. El-Habba, F. Al-Mulhim, The competitiveness of the Saudi Arabian date palm: An analytical study, Afr. J. Agric. Res. 8(43) (2013) 5260-5267, incorporated herein by reference in its entirety. During this period, the area planted with date palm trees in Saudi Arabia increased by 152% while the production increased by 153% during the same period. The most commercially important parts of the date palm tree are the sweet fruits. Other parts of the tree, such as the trunk, the stems, the roots, the leaves, the inflorescence, the pulp, the empty fruit bunches, the seeds (date pit), the shells/husks of the seeds, the offshoot, etc. are largely considered to be waste with insignificant economic value.

The date palm extract used herein is preferably a date palm leaves extract. The date palm leaves typically have a pinnate (feather) shape, although use of extracts derived from unopened date palm leaves are also contemplated for use herein. The leaves may be harvested from various varieties/cultivars of date palms, including, but not limited to, Ajwah, Al-Khunaizi, Dabbas, Khadrawi, Khalasah, Khasab, Medjool, Mishriq, Mazafati, Deglet Noor, Nabtat-seyf, Safawi, Sag'ai, Sukkary, Barhee, Hallawy, Sellaj, Umelkhashab, Tabarzal, Jarvis, Boyer, and Fard varieties/cultivars. The extract may be obtained from any part of the date palm leaf, including the midribs (the very base of the date leaf which encircles the palm as a fibrous sheath), the leaflets (the leafy extensions from the midrib), the spines (specialized leaflets converted into tough pointed pins situated at the lower end of the midrib), the sheathes (tender cover tissue from which new date palm leaves grow), or the leaf as a whole (parts from all of the above). In preferred embodiments, the extract is obtained from date palm leaves which have been separated from the midribs, and thus the extract is predominantly sourced from date palm leaflets. The date palm leaves may also be harvested for extraction during any growth cycle, for example, the leaves may be harvested from a date palm prior to pollination, or during the Hanabauk, Kimri, Khalal (Bisr), Rutab, or Tamr fruiting stage.

Date palm leaves typically contain carbohydrates, alkaloids, saponins, sterols/terpenes, steroids, flavanoids, tannins, phenolic compounds, proteins, amino acids, phytosterol, and glycosides, and extracts from date palm leaves are different and distinct, in terms of both constitution and performance as a corrosion inhibitor, from extracts sourced from other parts of date palm plants, including, but not limited to, extracts sourced from date palm trunk, stem, root, inflorescence, fruit ("date"), pulp, empty fruit bunches, seeds (date pit), shells/husks of the seeds, and offshoot, as well as extracts sourced from other plants or agricultural products.

The date palm leaves extract may be employed in varying quantities with beneficial effect, though the date palm leaves extract is typically employed herein in an amount of 0.1 to 10 wt. %, preferably 0.2 to 8 wt. %, preferably 0.6 to 7 wt. %, preferably 0.8 to 6 wt. %, preferably 1 to 5 wt. %, preferably 2 to 4.5 wt. %, preferably 2.5 to 4 wt. %, preferably 3 to 3.5 wt. %, based on a total weight of the corrosion inhibitor composition.

In addition to the part of the date palm harvested, the extraction procedure, particularly the extraction solvent, dictates the chemical make-up of the extract, as is well understood in the art. The inventors have found that extracts from date palm leaves, and in particular, ethanolic extracts from date palm leaves provide the corrosion inhibitor composition with advantageous corrosion inhibition properties.

Briefly, the ethanolic date palm leaves extract may be obtained by the following method. Fresh date palm leaves may be collected or otherwise obtained and washed thoroughly with water (e.g., tap water and/or distilled water). The date palm leaves may then be dried using any method and for any amount of time that provides an adequately dried product, typically to provide a dried product having a moisture content below 5 wt. %, preferably below 4 wt. %, preferably below 3 wt. %, preferably below 2 wt. %, preferably below 1 wt. %. For example, the date palm leaves may be dried in an oven at 90 to 140° C., preferably 95 to 130° C., preferably 100 to 120° C., preferably about 105 to 110° C., for 1 to 24 hours, preferably 2 to 20 hours, preferably 3 to 16 hours, preferably 4 to 12 hours. Alternatively, the date palm leaves may be dried under sun-drying conditions for 48 to 96 hours, preferably 60 to 84 hours, preferably 70 to 72 hours.

The dried date palm leaves may then be cut/chopped/sliced into smaller pieces, and the smaller pieces may be ground/pulverized into powder form using any suitable means, for example by grinding, ball milling, blending, etc. using manual methods (e.g., mortar) or machine-assisted methods such as using a mechanical blender or any other apparatus known to those of ordinary skill in the art. In some embodiments, the dried date palm leaves are ground to an average particle size of less than 200 μm, preferably less than 100 μm, preferably less than 50 μm, preferably less than 40 μm, preferably less than 30 μm, preferably less than 20 μm.

Next, the date palm leaves (preferably the powdered form) are extracted with an extraction solvent. In preferred embodiments, the extraction solvent is an ethanolic solvent, for example an ethanolic solvent that contains at least 80 wt. %, preferably at least 85 wt. %, preferably at least 90 wt. %, preferably at least 95 wt. %, preferably at least 99 wt. %, preferably at least 99.5 wt. %, preferably at least 99.9 wt. % ethanol, preferably 100 wt. % ethanol, with specific mention being made to absolute ethanol. Typically, the extraction is performed using a w/v (g/L) ratio of 10 to 40 g, preferably 15 to 30 g, preferably 20 to 25 g of date palm leaves per L of ethanolic solvent.

Extraction may be performed, for example, using a soxhlet extractor or similar extraction apparatus with the ethanolic solvent described above under conditions of reflux (e.g., about 75 to 80° C.) for 0.5 to 12 hours, preferably 1 to 10 hours, preferably 2 to 8 hours, preferably 4 to 6 hours. Alternatively, extraction may be performed by soaking the powdered leaves in the ethanolic solvent for an extended period, such as for 24 to 96 hours, preferably 48 to 72 hours. In either case, the extraction supernatant may be separated from any bulk solid material (performed automatically when using a soxhlet extractor), and the ethanolic solvent may then be evaporated from the extraction supernatant, for example using a rotary evaporator under reduced pressure and optional elevated temperature (e.g., 40 to 75° C., preferably 55 to 65° C.) to provide the ethanolic date palm leaves extract as the remaining semi-solid residue.

The ethanolic date palm leaves extract may contain, as substantial constituents, flavonoids, phenolic compounds, steroids, and saponins, as determined by lead ethanoate tests, ferric chloride tests, Shinoda's tests, Liebermann-Burchard test, and boiling/frothing analysis, for example. In preferred embodiments, the ethanolic date palm leaves extract has a total phenolic content (expressed as mg of gallic acid equivalents per gram of extract, mg GAE/g) of 65 to 74 mg/g, preferably 66 to 73 mg/g, preferably 67 to 72 mg/g, preferably 68 to 71 mg/g, preferably 69 to 70 mg/g, as determined by either the Folin-Ciocalteu assay (See e.g, El Sohaimy SA. The effect of cooking on the chemical composition of artichoke (*Cynara scolymus* L.). Afr J Food Sci Technol 2013, 3:182-7, incorporated herein by reference in its entirety) or with high-performance liquid chromatography (HPLC) according to the method reported by Mattila et al. (Mattila, P., J. Astola, and J. Kumpulainen, "Determination of Flavonoids in Plant Material by HPLC with Diode-Array and Electro-Array Detections", Journal of Agricultural and Food Chemistry, 2000, 48, 5834-5841). Exemplary phenolic compounds which may be present in the ethanolic date palm leaves extract may include, but are not limited to, quercetin and isorhamnetin heterosides, (+)-catechin, and (−)-epicatechin.

In some embodiments, the ethanolic date palm leaves extract is substantially free of tannins, alkaloids, and terpenoids as determined, for example, by ferric chloride tests, Dragendorff's reagent/Mayer's reagent tests, and acetic anhydride/hydrogen sulfate tests.

In some embodiments, the ethanolic date palm leaves extract described above may be subjected to resin column fractionation to purify and isolate certain fractions, for example, those fractions which are rich in phenolic compounds (Xie, W. et al. "Hypolipidemic Mechanisms of *Ananas comosus* L. Leaves in Mice: Different From Fibrates but Similar to Statins" Journal of Pharmacological Sciences, 2007, 103, 267-274; Ma, Chao et al. "Characterization of active phenolic components in the ethanolic extract of *Ananas comosus* L. leaves using high-performance liquid chromatography with diode array detection and tandem mass spectrometry" Journal of Chromatography A, 2007, 1165(1-2), 39-44, each incorporated herein by reference in its entirety). For example, the extraction supernatant obtained from above may be loaded onto a resin column preconditioned with ethanol (e.g., 95 wt. % ethanol). Then, the supernatant of the crude extract may be eluted with distilled water until no sugar was detected with a sulfuric acid-phenol colorimetric method. Subsequently, the column may be eluted with aqueous ethanol (e.g., 80 to 90 wt. %) and a phenolic rich fraction may be collected and dried for example under vacuum or heat. The resulting phenolic rich ethanolic date palm leaves extract may have a total phenolic content of 50 to 60 wt. %, preferably 52 to 58 wt. %, preferably 54 to 56 wt. %, based on a total weight of the phenolic rich ethanolic date palm leaves extract, as determined by HPLC analysis.

It should be noted that while the use of other extracts (e.g., plant extracts) is contemplated herein, in preferred embodiments, the only extract (e.g., plant extract) present in the corrosion inhibitor composition is the date palm leaves extract, preferably the ethanolic date palm leaves extract. In preferred embodiments, the corrosion inhibitor composition is substantially free of extracts obtained from other date palm parts (e.g., extracts from the trunk, the stems, the roots, the inflorescence, the fruit, the pulp, the empty fruit bunches, the seeds (date pit), the shells/husks of the seeds, and the offshoots of date palm plants), as well as extracts obtained from other plant varieties including, but not limited to, *Zenthoxylum alatum* plant extract, *Schinopsis lorentzii* extract, *Aqudaria subintergra* leaves extract, *Rollinia occidentalis* extract, *Thymus algeriensis* extract, *Olea europaea* extract (e.g., olive leaves extract), *Acalypha torta* leaf extract, *Ananas comosus* extract (including extracts from pineapple stem, pineapple fruit, pineapple residual pulp, pineapple peel, pineapple leaves, pineapple fibers, and the like).

Benzimidazole Compound

The corrosion inhibitor composition disclosed herein also contains at least one benzimidazole compound having at least one a carbamate group, preferably one carbamate group, preferably one carbamate group located at the 2-position of the benzimidazole structure.

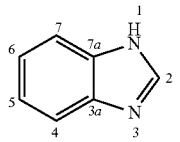

benzimidazole

The benzimidazole compound may be present in an amount of 0.1 to 8 wt. %, preferably 0.2 to 7 wt. %, preferably 0.4 to 6 wt. %, preferably 0.6 to 5 wt. %, preferably 0.8 to 4 wt. %, preferably 1 to 3 wt. %, preferably 1.5 to 2 wt. %, based on a total weight of the corrosion inhibitor composition.

Preferred benzimidazole compounds are those which are substituted at least at the 2-position of benzimidazole (preferably with a carbamate functional group), preferably the benzimidazole compound is a 2,5-disubstituted benzimidazole or a 2,6-disubstituted benzimidazole (which is the tautomeric form of the 2,5-disubstittued benzimidazole). In preferred embodiments, the benzimidazole compound is of formula (I) or a tautomer thereof (I)

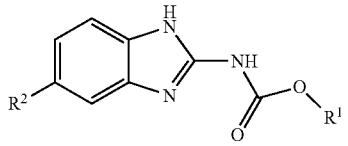

wherein:

$R^1$ is a an optionally substituted alkyl, an optionally substituted aryl, an optionally substituted arylalkyl, or an optionally substituted heterocyclyl; and $R^2$ is a hydrogen, an optionally substituted alkyl, an optionally substituted aryl, an optionally substituted arylalkyl, an optionally substituted heterocyclyl, an optionally substituted amide, a mercapto, an optionally substituted alkylthio, an optionally substituted arylthio, an optionally substituted alkoxy, a hydroxyl, a carboxy, a halo, an optionally substituted alkanoyloxy, an optionally substituted alkoxycarbonyl, an optionally substituted aroyl, or an optionally substituted alkanoylamino.

Such benzimidazole compounds of formula (I), in which the $R^2$ substituent occupies the 5-position, may readily tautomerize (the hydrogen atom attached to the nitrogen in the 1-position may ready tautomerize) to the benzimidazole compound of formula (Ia), in which the $R^2$ substituent occupies the 6-position.

(Ia)

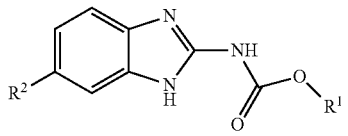

This tautomeric form (i.e., the benzimidazole compound of formula (Ia)) is considered herein to be included in the phrase "or a tautomer thereof" when referencing the benzimidazole compound of formula (I), and thus any description regarding the benzimidazole compound of formula (I) should be equally extended to the benzimidazole compound of formula (Ia).

In some embodiments, $R^1$ is an optionally substituted alkyl, preferably an unsubstituted alkyl, preferably a $C_1$-$C_4$ alkyl, preferably a $C_1$-$C_3$ alkyl, preferably $C_1$-$C_2$ alkyl, such as methyl, ethyl, propyl, butyl. Preferably $R^1$ is methyl or ethyl, preferably methyl. In some embodiments, $R^1$ is an optionally substituted aryl, preferably an optionally substituted aryl having 6 to 12 carbon atoms, preferably 7 to 10 carbon atoms, preferably 8 to 9 carbon atoms, with specific mention being made to phenyl, an alkyl substituted phenyl (e.g., tolyl), and an alkoxy substituted phenyl (e.g., methoxyphenyl, ethoxyphenyl, etc.). Alternatively, $R^1$ may be an optionally substituted arylalkyl such as benzyl, 2-phenethyl, 2-phenylpropyl, 3-phenylpropyl, and the like, preferably benzyl.

In some embodiments, $R^2$ is the same as $R^1$. In some embodiments, $R^2$ is different from $R^1$. In some embodiments, $R^2$ is hydrogen.

In some embodiments, $R^2$ is an optionally substituted alkyl group, preferably an optionally substituted $C_1$-$C_4$ alkyl, preferably an optionally substituted $C_1$-$C_3$ alkyl, preferably an optionally substituted $C_1$-$C_2$ alkyl, for example, a methyl, ethyl, propyl, butyl, trifluoromethyl, 2-cyanoethyl, 2-alkoxyethyl (e.g., 2-methoxyethyl), 2-hydroxyethyl, and the like.

In some embodiments, $R^2$ is an optionally substituted aryl, preferably an optionally substituted aryl having 6 to 12 carbon atoms, preferably 7 to 10 carbon atoms, preferably 8 to 9 carbon atoms, with specific mention being made to phenyl, an alkyl substituted phenyl (e.g., tolyl), and an alkoxy substituted phenyl (e.g., methoxyphenyl, ethoxyphenyl, etc.).

In some embodiments, $R^2$ is an optionally substituted heterocyclyl (e.g., 4-morpholinyl), preferably an optionally substituted heteroaryl (e.g., an optionally substituted pyridyl), preferably an optionally substituted heteroaryl containing at least one sulfur atom in the heteroaromatic ring structure, with specific mention being made to thienyl, thiazolyl, benzothienyl, and benzthiazolyl.

In some embodiments, $R^2$ is a mercapto group (HS—). In some embodiments, $R^2$ is an alkylthio, preferably a $C_1$-$C_4$ alkylthio, for example, methylthio, ethylthio, propylthio, or butylthio. In some embodiments, $R^2$ is an optionally substituted arylthio, preferably an unsubstituted arylthio, with phenylthio being most preferred.

In some embodiments, $R^2$ is an optionally substituted aroyl, preferably an unsubstituted aroyl, preferably a benzoyl group.

Specific examples of the benzimidazole compound having at least one a carbamate group may include, but are not limited to, methyl N-(5-benzoyl-1H-benzimidazol-2-yl)carbamate, methyl N-(5-morpholin-4-yl-1H-benzimidazol-2-yl)carbamate, methyl N-(5-pyridin-3-yl-1H-benzimidazol-2-yl)carbamate, methyl N-(5-methyl-1H-benzimidazol-2-yl)carbamate, methyl N-(1H-benzimidazol-2-yl)carbamate (carbendazim), methyl N-(5-propylsulfanyl-1H-benzimidazol-2-yl)carbamate, methyl N-(5-phenylsulfanyl-1H-benzoimidazol-2-yl)carbamate, methyl N-(5-propoxy-1H-benzimidazol-2-yl)carbamate, or tautomers of any of the above where the substituent attached to the carbocyclic ring occupies instead the 6-position such as fenbendazole (methyl N-(6-phenylsulfanyl-1H-benzoimidazol-2-yl)carbamate), mebendazole, albendazole (methyl N-(6-propylsulfanyl-1H-benzimidazol-2-yl)carbamate), oxibendazole, etc., as well as mixtures thereof.

Pyridine Compound

The corrosion inhibitor composition disclosed herein also contains at least one pyridine compound. The pyridine compound may be present in an amount of 0.05 to 5 wt. %, preferably 0.08 to 4 wt. %, preferably 0.1 to 3 wt. %, preferably 0.15 to 2 wt. %, preferably 0.2 to 1.5 wt. %, preferably 0.25 to 1 wt. %, preferably 0.3 to 0.5 wt. %, based on a total weight of the corrosion inhibitor composition.

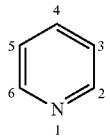

Pyridine

The pyridine compound may be unsubstituted (pyridine), but is preferably substituted at least at the 2-position and/or the 5-position of the pyridine ring, preferably the pyridine compound is a 2,5-disubstituted pyridine. In preferred embodiments, the pyridine compound is of formula (II)

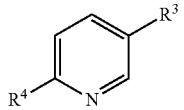

(II)

wherein:

$R^3$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, a halo, an optionally substituted alkoxycarbonyl, or an optionally substituted amino; and $R^4$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, an optionally substituted alkoxycarbonyl, a formyl, or an optionally substituted amino.

In some embodiments, $R^3$ is an optionally substituted alkyl group, preferably an optionally substituted $C_1$-$C_4$ alkyl, preferably an optionally substituted $C_1$-$C_3$ alkyl, preferably an optionally substituted $C_1$-$C_2$ alkyl, for example, a methyl, ethyl, propyl, butyl, trifluoromethyl, 2-cyanoethyl, 2-alkoxyethyl (e.g., 2-methoxyethyl), 2-hydroxyethyl, and the like. In some embodiments, $R^3$ is an optionally substituted aryl, preferably an optionally substituted aryl having 6 to 12 carbon atoms, preferably 7 to 10 carbon atoms, preferably 8 to 9 carbon atoms, with specific mention being made to phenyl, an alkyl substituted phenyl (e.g., tolyl), and an alkoxy substituted phenyl (e.g., methoxyphenyl, ethoxyphenyl, etc.).

In some embodiments, $R^3$ is a mercapto group (HS—). In some embodiments, $R^3$ is an alkylthio, preferably a $C_1$-$C_4$ alkyl thio, for example, methylthio, ethylthio, propylthio, or butylthio.

In some embodiments, $R^3$ is a carboxy (carboxylic acid or carboxylate salt). In some embodiments, $R^3$ is an optionally substituted amino, preferably an unsubstituted amino (—$NH_2$), or an amino group substituted with one or more alkyl groups (—NHalkyl or N(alkyl)alkyl), where each alkyl group may in turn be optionally substituted.

In some embodiments, $R^3$ is the same as $R^4$. In some embodiments, $R^3$ is different from $R^4$. In some embodiments, $R^4$ is hydrogen.

In some embodiments, $R^4$ is an optionally substituted alkyl group, preferably an optionally substituted $C_1$-$C_4$ alkyl, preferably an optionally substituted $C_1$-$C_3$ alkyl, preferably an optionally substituted $C_1$-$C_2$ alkyl, for example, a methyl, ethyl, propyl, butyl, trifluoromethyl, 2-cyanoethyl, 2-alkoxyethyl (e.g., 2-methoxyethyl), 2-hydroxyethyl, and the like. In some embodiments, $R^4$ is an optionally substituted aryl, preferably an optionally substituted aryl having 6 to 12 carbon atoms, preferably 7 to 10 carbon atoms, preferably 8 to 9 carbon atoms, with specific mention being made to phenyl, an alkyl substituted phenyl (e.g., tolyl), and an alkoxy substituted phenyl (e.g., methoxyphenyl, ethoxyphenyl, etc.).

In some embodiments, $R^4$ is a mercapto group (HS—). In some embodiments, $R^4$ is an alkylthio, preferably a $C_1$-$C_4$ alkylthio, for example, methylthio, ethylthio, propylthio, or butylthio. In some embodiments, $R^4$ is a carboxy (carboxylic acid or carboxylate salt). In some embodiments, $R^4$ is an optionally substituted amino, preferably an unsubstituted amino (—$NH_2$), or an amino group substituted with one or more alkyl groups (—NHalkyl or —N(alkyl)alkyl), where each alkyl group may in turn be optionally substituted.

Exemplary pyridine compounds may include, but are not limited to, pyridine, 2,5-pyridinedicarboxylic acid, 2,5-lutidine, 5-ethyl-2-methylpyridine, 2-methylpyridine, 2,5-diaminopyridine, 6-methylpyridine-3-carboxlyic acid, dimethyl 2,5-pyridine dicarboxylate, 6-hydroxymethyl-nicotinic acid methyl ester, methyl nicotinate, methyl 6-formylnicotinate, 6-methylpyridine-3-carboxylic acid, 5-amino-2-(trifluoromethyl)pyridine, 5-amino-2-methoxypridine, 2,5-dimethoxypyridine, 2-mercaptopyridine, 6-mercaptopyridine-3-carboxylic acid, 2-pyridylethylmercaptan, 5-(trifluoromethyl)pyridine-2-thiol, 5-chloropyridine-2-thiol, 5-bromo-2-(trifluoromethyl)pyridine, 5-bromo-2-pyridinecarboxaldehyde, 5-chloro-2-formylpyridine, 5-chloro-2-pyridinecarboxylic acid, as well as mixtures thereof, with 6-mercaptopyridine-3-carboxylic acid being the most preferred.

Thiourea Compound

The corrosion inhibitor composition disclosed herein also contains at least one thiourea compound. The thiourea compound may be present in an amount of 0.01 to 5 wt. %, preferably 0.05 to 4 wt. %, preferably 0.08 to 3 wt. %, preferably 0.1 to 2 wt. %, preferably 0.15 to 1.5 wt. %, preferably 0.2 to 1 wt. %, preferably 0.25 to 0.5 wt. %, based on a total weight of the corrosion inhibitor composition.

The thiourea compound may be unsubstituted (thiourea) or may be a mono-N-substituted, di-N-substituted, tri-N-substituted, or tetra-N-substituted thiourea compound. The thiourea compound may be symmetric or asymmetric. The thiourea compound may be an acyclic compound or a cyclic compound, for example when the nitrogen atoms of the thiourea functional group are present as ring atoms of a heterocyclic ring structure.

In preferred embodiments, the thiourea compound is of formula (III)

(III)

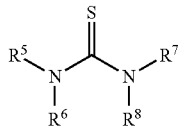

wherein:

$R^5$ and $R^7$ are independently a hydrogen, an optionally substituted alkyl, an optionally substituted aryl, or an optionally substituted arylalkyl; and $R^6$ and $R^8$ are independently a hydrogen, an optionally substituted alkyl, an optionally substituted aryl, or an optionally substituted arylalkyl, or wherein $R^6$ and $R^8$ together with the nitrogen atoms to which they are attached, form a 5- or 6-membered ring.

$R^5$, $R^6$, $R^7$, and/or $R^8$ may be an optionally substituted $C_1$-$C_{22}$ alkyl, preferably a $C_2$-$C_{18}$ alkyl, preferably a $C_3$-$C_{12}$ alkyl, preferably a $C_4$-$C_6$ alkyl, preferably the alkyl group is unsubstituted, for example, is a methyl, ethyl, propyl, or butyl.

$R^5$, $R^6$, $R^7$, and/or $R^8$ may be an optionally substituted aryl, preferably an optionally substituted aryl having 6 to 12 carbon atoms, preferably 7 to 10 carbon atoms, preferably 8 to 9 carbon atoms, with specific mention being made to phenyl, an alkyl substituted phenyl (e.g., tolyl), and an alkoxy substituted phenyl (e.g., methoxyphenyl, ethoxyphenyl, etc.), with 2-methoxyphenyl being the most preferred.

$R^5$, $R^6$, $R^7$, and/or $R^8$ may be an optionally substituted arylalkyl, with specific mention being made to benzyl, phenethyl, and 4-methylbenzyl.

Suitable examples of the thiourea compound include, but are not limited to, thiourea, N-methylthiourea, N,N'-dimethylthiourea, tetramethylthiourea, N-ethylthiourea, N,N'-diethylthiourea, tetraethylthiourea, N-propylthiourea, N,N'-dipropylthiourea, N-butylthiourea, N,N'-dibutylthiourea, 1-(2-Methoxyphenyl)-2-thiourea, N,N'-diphenylthiourea, as well as mixtures thereof, with a mixture of 1-(2-Methoxyphenyl)-2-thiourea and N,N'-diphenylthiourea being the most preferred.

In some embodiments, the thiourea compound of formula (III) is a cyclic compound where $R^5$ and $R^7$ are as described above and $R^6$ and $R^8$, together with the nitrogen atoms to which they are attached, form a 5- or 6-membered ring. Acceptable examples of such cyclic thiourea compounds include, but are not limited to, imidazolidine-2-thione (N,N'-ethylenethiourea), tetrahydropyrimidine-2(1H)-thione, as well as mixtures thereof.

Cinnamaldehyde Compound

The corrosion inhibitor composition of the present disclosure also contains at least one cinnamaldehyde compound. The cinnamaldehyde compound generally contains an optionally substituted aryl group separated from an aldehyde moiety (or a functional group mimic, protecting group, or isostere thereof) by one unsaturated carbon-carbon double bond or a two or more unsaturated carbon-carbon double bonds in conjugation (i.e., polyene moiety), the simplest of which is cinnamaldehyde (i.e., 3-phenyl-2-propen-1-al, $C_6H_5CH{=}CHCHO$), which may be obtained naturally from cinnamon oil. The double bond(s) that link, and are in conjugation with, the aryl group and the aldehyde moiety causes the geometry of such compounds to be planar and, therefore, cis and/or trans isomers may be present. In preferred embodiments, the cinnamaldehyde compound has a trans-configuration or when a mixture of isomers is present, a majority of the double bonds exist in the trans-isomer configuration. In this context, "majority" means that if the cinnamaldehyde compound contains a mixture of isomers, the trans-configuration is present in a proportion greater than 50 wt. %, preferably greater than 60 wt. %, preferably greater than 70 wt. %, preferably greater than 80 wt. %, preferably greater than 90 wt. %, preferably greater than 95 wt. % of said mixture.

In preferred embodiments, the cinnamaldehyde compound is of formula (IV)

(IV)

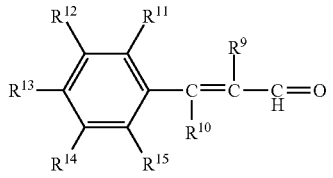

wherein:

$R^9$ and $R^{10}$ are independently hydrogen, an optionally substituted alkyl, an optionally substituted aryl, an optionally substituted alkoxy, or a halo, and $R^{11}$ to $R^{15}$ are independently hydrogen, an optionally substituted alkyl, an optionally substituted aryl, an optionally substituted alkoxy, an optionally substituted aroyl, an optionally substituted alkanoyl, an optionally substituted alkanoyloxy, a carboxy, an optionally substituted alkoxycarbonyl, a hydroxy, a halo, an optionally substituted amino (e.g., —$NH_2$, —$NHR_a$, or —$N(R_a)_2$), an alkyl ammonium salt of the formula —$(N(R_a)_3)^+$, a nitro, a cyano, an optionally substituted alkylthio, a sulfate anion, an alkylsulfate, or wherein two of these adjacent substituents represented by $R^{11}$, $R^{12}$, $R^{13}$, $R^{14}$ or $R^{15}$, together form a methylene dioxy group, and wherein each $R_a$ is independently an optionally substituted alkyl, an optionally substituted arylalkyl, or an optionally substituted aryl group.

In preferred embodiments, $R^9$ and $R^{10}$ are independently hydrogen, an optionally substituted $C_1$-$C_6$ alkyl, preferably an optionally substituted $C_1$, $C_2$, or $C_3$ alkyl, or a halo, preferably a hydrogen, or methyl.

In some embodiments, $R^{11}$ to $R^{15}$ are independently hydrogen, an optionally substituted alkyl, an optionally substituted alkoxy, an optionally substituted alkanoyloxy, a carboxy, an optionally substituted alkoxycarbonyl, a hydroxy, a halo, an optionally substituted amino, or wherein two of these adjacent substituents represented by $R^{11}$, $R^{12}$, $R^{13}$, $R^{14}$ or $R^{15}$, together form a methylene dioxy group.

In preferred embodiments, $R^{11}$ to $R^{15}$ are independently hydrogen, an optionally substituted $C_1$-$C_6$ alkyl, preferably an optionally substituted $C_2$-C6 alkyl, preferably a methyl, ethyl or propyl, an optionally substituted $C_1$-$C_4$ alkoxy (e.g., methoxy, ethoxy), nitro, or a halo.

Examples of cinnamaldehyde compounds that can be used herein include, but are not limited to, cinnamaldehyde (i.e., $R^9$ to $R^{15}$ are each hydrogen), p-hydroxycinnamaldehyde, p-methylcinnamaldehyde, p-ethylcinnamaldehyde, p-methoxycinnamaldehyde, 2,4,5-trimethoxycinnamaldehyde, 3,4,5-trimethoxycinnamaldehyde, 3,4-dimethoxycinnamaldehyde, 1-ethoxy-2-acetoxycinnamaldehyde, 1-ethoxy-2-hydroxycinnamaldehyde, sinapaldehyde, 2,5-dimethoxy-3,4-methylenedioxycinnamaldehyde, 2-methoxy-4,5-methylenedioxy cinnamaldehyde, coniferyl aldehyde, 2,3-dimethoxy-4,5-methylenedioxycinnamaldehyde, p-dimethylaminocinnamaldehyde, p-diethylaminocinnamaldehyde, p-nitrocinnamaldehyde, o-nitrocinnamaldehyde, 3,4-methylenedioxycinnamaldehyde, sodium p-sulfocinnamaldehyde, p-trimethylammoniumcinnamaldehyde o-methylsulfate, p-chlorocinnamaldehyde, α-methylcinnamaldehyde, β-methylcinnamaldehyde, α-chlorocinnamaldehyde, α-bromocinnamaldehyde, α-butylcinnamaldehyde, α-amylcinnamaldehyde, α-hexylcinnamaldehyde, α-bromo-p-cyanocinnamaldehyde, α-ethyl-p-methylcinnamaldehyde, and p-methyl-α-pentylcinnamaldehyde, as well as mixtures thereof. In more preferred embodiments, the cinnamaldehyde compound employed in the corrosion inhibitor composition is cinnamaldehyde.

Other cinnamaldehyde analogs that may be used herein include, but are not limited to, $C_1$-$C_{12}$ alkyl acetals or hemiacetals of any cinnamaldehyde compound previously listed (e.g., cinnamaldehyde dimethyl acetal), oxime variants of any cinnamaldehyde compound previously listed (e.g., cinnamaloxime), nitrile variants of an cinnamaldehyde compound previously listed (e.g., cinnamonitrile), or polyene variants of any cinnamaldehyde previously listed (e.g., 5-phenyl-2,4-pentadienal and 7-phenyl-2,4,6-heptatrienal).

In some embodiments, the cinnamaldehyde compound is present in the corrosion inhibitor composition in amounts of 0.001 to 2 wt. %, preferably 0.005 to 1 wt. %, preferably 0.01 to 0.8 wt. %, preferably 0.015 to 0.6 wt. %, preferably 0.018 to 0.4 wt. %, preferably 0.02 to 0.3 wt. %, preferably 0.022 to 0.2 wt. %, preferably 0.024 to 0.15 wt. %, preferably 0.026 to 0.1 wt. %, preferably 0.03 to 0.05 wt. %, preferably based on a total weight of the corrosion inhibitor composition. Without being bound by theory, the cinnamaldehyde compound herein may inhibit corrosion caused by acidic mediums by undergoing an acid catalyzed polymerization reaction thereby forming a thin film on the metal surface being protected.

Metal Iodide

One or more metal iodides may also be incorporated into the corrosion inhibitor composition. Such metal iodides, when combined with the various other ingredients in the corrosion inhibitor composition may act as intensifiers to further diminish the rate of corrosion. Examples of metal iodides which may be used herein include, but are not limited to, sodium iodide, potassium iodide, copper(I) iodide, copper(II) iodide, with preferred metal iodides being sodium iodide and potassium iodide, or a mixture thereof.

In some embodiments, the metal iodide is present in an amount of 0.05 to 5 wt. %, preferably 0.08 to 4 wt. %, preferably 0.1 to 3 wt. %, preferably 0.12 to 2 wt. %, preferably 0.16 to 1.5 wt. %, preferably 0.18 to 1 wt. %, preferably 0.2 to 0.8 wt. %, preferably 0.24 to 0.6 wt. %, based on a total weight of the corrosion inhibitor composition.

Urotropin

The corrosion inhibitor composition may also include urotropin (hexamethylenetetramine, $(CH_2)_6N_4$), which is fused aza polycycle having a cage like structure, specifically a fused tricyclic tetraamine (contains four tertiary amino groups).

In some embodiments, the urotropin is present in an amount of 0.1 to 8 wt. %, preferably 0.2 to 7 wt. %, preferably 0.4 to 6 wt. %, preferably 0.6 to 5 wt. %, preferably 0.8 to 4 wt. %, preferably 1 to 3 wt. %, preferably 1.5 to 2 wt. %, based on a total weight of the corrosion inhibitor composition.

Other fused aza polycycles are also contemplated for use herein, either in addition to or in lieu of urotropin. Examples of such other fused aza polycycles include, but are not limited to, tropane, nortropane, quinucleodine (1-azabicyclo[2.2.2]octane, ABCO), and 1,4-diazabicyclo[2.2.2]octane (DABCO).

Base Fluid

The base fluid typically accounts for the majority of the corrosion inhibitor composition, and is designed, for example, to aid solvation of the various ingredients as well as facilitate transfer of the corrosion inhibitor composition.

In some embodiments, the base fluid is present in an amount of 80 to 98 wt. %, preferably 82 to 97.5 wt. %, preferably 84 to 97 wt. %, preferably 86 to 96.5 wt. %, preferably 88 to 96 wt. %, preferably 90 to 95.5 wt. %, preferably 92 to 95 wt. %, preferably 93 to 94.5 wt. %, preferably 94 wt. %, based on a total weight of the corrosion inhibitor composition.

The base fluid may comprise, consist essentially of, or consist of, an alcohol and an organic acid. "Consist essentially of" in this context refers to base fluids which contain an alcohol and an organic acid and may optionally contain minimal or trace amounts of water, for example, less than 5 wt. % water, preferably less than 4 wt. % water, preferably less than 3 wt. % water, preferably less than 2 wt. % water, preferably less than 1 wt. % water, preferably less than 0.5 wt. % water, preferably less than 0.1 wt. % water. In some embodiments, a w/w ratio of the organic acid to the alcohol is 5:1 to 50:1, preferably 10:1 to 45:1, preferably 15:1 to 40:1, preferably 20:1 to 35:1, preferably 25:1 to 32:1, preferably 30:1 to 31:1, preferably. In preferred embodiments, the base fluid consists of the organic acid and the alcohol.

The organic acid may be a monoacid, a diacid, or a triacid, preferably the organic acid is a monoacid. Useful organic acids of the present disclosure are liquid at room temperature, i.e., have a melting temperature of less than about 25° C. Such organic acids may include, but are not limited to, acetic acid, formic acid, propionic acid, butyric acid, pentanoic acid, hexanoic acid, lactic acid, and medium chain ($C_8$ to $C_{12}$) fatty acids (e.g., caprylic acid, capric acid, lauric acid) including mixtures thereof. In preferred embodiments, the organic acid is formic acid.

The alcohol may be a monoalcohol, a polyalcohol, or a combination thereof. Exemplary monoalcohols include, but are not limited to, methanol, ethanol, propanol, isopropanol, n-butanol, isobutanol, n-pentanol, n-hexanol, 3-methyl-3-buten-1-ol, 2-ethyl-1-hexanol, 2-ethyl-1-butanol, 2-propyl-heptan-1-ol, and 2-butyl-1-octanol, including mixtures thereof, with specific mention being made to ethanol. Exemplary polyalcohols include, but are not limited to, ethylene glycol, diethylene glycol, triethylene glycol, tetraethylene glycol, propylene glycol, dipropylene glycol, 1,3-propanediol, 1,3-butanediol, 1,4-butanediol, 1,6-hexanediol, glycerol, pentaerythritol, manitol, and sorbitol, including mixtures thereof. In preferred embodiments, the alcohol is a monoalcohol, preferably one of methanol, ethanol, propanol, isopropanol, and isobutanol, preferably ethanol.

Other (non-alcohol based) organic solvents may optionally be included in the base fluid (in addition to the alcohol described above), for example to aid solvation of the various ingredients of the corrosion inhibitor composition. The other organic solvent(s) may be added in amounts of 1 to 20 wt. %, preferably 3 to 15 wt. %, preferably 5 to 10 wt. %, preferably 6 to 8 wt. %, based on a total weight of the base fluid. The other organic solvents may be any solvent that is miscible with water, preferably a polar aprotic solvent. Acceptable other organic solvents include, but are not limited to, formamide, dimethyl formamide, dimethyl acetamide, acetone, methyl ethyl ketone, ethylene glycol methyl ether, ethylene glycol ethyl ether, ethylene glycol propyl ether, and ethylene glycol butyl ether.

Supplemental Corrosion Inhibitor(s)

The corrosion inhibitor composition may also optionally include one or more supplemental corrosion inhibitors, which is a term used herein to define any substance/compound which imparts or is expected to impart a material anticorrosive effect when included in the corrosion inhibitor composition, other than those present in the corrosion inhibitor composition as described above (e.g., date palm leaves extract, a benzimidazole compound having at least one a carbamate group, a pyridine compound, a thiourea compound, a cinnamaldehyde compound, a metal iodide, urotropin). Therefore, the term supplemental corrosion inhibitor is meant to be distinct and separate from the corrosion inhibitor composition and the compounds present therein. When used, the supplemental corrosion inhibitor may be present in amounts of 0.001 to 5 wt. %, preferably 0.01 to 4 wt. %, preferably 0.1 to 3 wt. %, preferably 0.5 to 2 wt. %, preferably 1 to 1.5 wt. %, based on a total weight of the corrosion inhibitor composition.

Any corrosion inhibitor known to those of ordinary skill in the art may be used herein as a supplemental corrosion inhibitor. Exemplary supplemental corrosion inhibitors include, but are not limited to, an alkoxylated fatty amine, which are compounds having a long-chain alkyl group made up of hydrogen and anywhere from 6 to 26 carbon atoms, preferably 8 to 22 carbon atoms, preferably 12 to 20 carbon atoms, more preferably 16 to 18 carbon atoms, bonded to an amine functional group which is alkoxylated, where the fatty portion may be derived/derivable from fatty acids or fatty acid mixtures such as caprylic acid, capric acid, lauric acid, myristic acid, palmitic acid, stearic acid, arachidic acid, behenic acid, lignoceric acid, cerotic acid, myristoleic acid, palmitoleic acid, sapienic acid, oleic acid, elaidic acid, vaccenic acid, linoleic acid, linoelaidic acid, α-inolenic acid, arachidonic acid, eicosapentaenoic acid, erucic acid, docosahexaenoic acid, tall oil fatty acid (TOFA), coconut oil fatty acid, tallow fatty acid, and soya fatty acid, and thus may saturated or may contain sites of unsaturation (e.g., mono-, di-, tri-, oligo-, or poly-unsaturated), with specific mention being made to a coconut amine alkoxylate, a stearyl amine alkoxylate, a palmitoleylamine alkoxylate, a oleylamine alkoxylate, a tallow amine alkoxylate, a tall oil amine alkoxylate, a laurylamine alkoxylate, a myristylamine alkoxylate, a cetylamine alkoxylate, a stearylamine alkoxylate, a linoleyl amine alkoxylate, a soya amine alkoxylate, as well as alkoxylated ethylene diamine variants thereof, alkoxylated trimethylene diamine variants thereof, alkoxylated diethylene triamine variants thereof, and alkoxylated dipropylene triamine variants thereof;

an imidazoline compound, which are those compounds which can be generally formed from a reaction between (i) a fatty acid or an ester derivative thereof, for example a $C_1$ to $C_{12}$ alkyl ester (e.g., methyl, ethyl, etc.) of a fatty acid or a glycerol ester of a fatty acid, and (ii) a polyamine which contains at least one ethylene diamine group (in various molar ratios between (i) and (ii)), such as those imidazoline compounds prepared from reaction between (i) tall oil fatty acid (TOFA), coconut oil fatty acid, tallow fatty acid, soya fatty acid, and/or oleic acid and (ii) any polyamine containing two, three, four, or more nitrogen groups, which may be primary, secondary, or tertiary amines, so long as at least one ethylene diamine group is present that is capable of reacting with a carboxylic acid group to form an imidazoline structure (e.g., ethylene diamine, β-hydroxyethyl ethylene diamine, 1,2-diaminopropane, 1,2-diaminocyclohexane, 2,3-diaminobutane, 2,3-diaminobutan-1-ol, propane-1,2,3-triamine, tris(2-aminoethyl)amine, tetraethylenepentamine (TEPA), diethylenetriamine (DETA), triethylentetramine (TETA), aminoethylethanolamine (AEEA), pentaethylene hexamine (PEHA), and hexaethylene heptamine (HEHA)), with specific mention being made to 1:1 (molar ratio) TOFA/DETA imidazoline, 2:1 TOFA/DETA imidazoline, 1:1 TOFA/TETA imidazoline, 2:1 TOFA/TETA imidazoline, 2:1 TOFA/TETA bis-imidazoline, 1:1 TOFA/TEPA imidazoline, 2:1 TOFA/TEPA imidazoline, 2:1 TOFA/TEPA bis-imidazoline, 3:1 TOFA/TEPA bis-imidazoline, 1:1 TOFA/AEEA imidazoline, 2:1 TOFA/AEEA imidazoline, 1:1 TOFA/polyamine imidazoline, 2:1 TOFA/polyamine imidazoline, 2:1 TOFA/polyamine bis-imidazoline, 3:1 TOFA/TEPA polyamine bis-imidazoline, 1:1 Soya/DETA imidazoline, 2:1 Soya/DETA imidazoline, 1:1 Soya/TETA imidazoline, 2:1 Soya/TETA imidazoline, 2:1 Soya/TETA bis-imidazoline, 1:1 Soya/TEPA imidazoline, 2:1 Soya/TEPA imidazoline, 2:1 Soya/TEPA bis-imidazoline, 3:1 TOFA/TEPA bis-imidazoline, 1:1 Soya/AEEA imidazoline, 2:1 Soya/AEEA imidazoline, 1:1 Soya/polyamine imidazoline, 2:1 Soya/polyamine imidazoline, 2:1 Soya/polyamine bis-imidazoline, 1:1 Tallow/DETA imidazoline, 2:1 Tallow/DETA imidazoline, 1:1 Tallow/TETA imidazoline, 2:1 Tallow/TETA imidazoline, 2:1 Tallow/TETA bis-imidazoline, 1:1 Tallow/TEPA imidazoline, 2:1 Tallow/TEPA imidazoline, 2:1 Tallow/TEPA bis-imidazoline, 3:1 Tallow/TEPA bis-imidazoline, 1:1 Tallow/AEEA imidazoline, 2:1 Tallow/AEEA imidazoline, 1:1 Tallow/polyamine imidazoline, 2:1 Tallow/polyamine imidazoline, 2:1 Tallow/polyamine bis-imidazoline, 3:1 Tallow/TEPA polyamine bis-imidazoline;

inorganic metal or organometallic compounds such as chromates, arsenates, zinc salts, iodates, metavanadates, and molybdates;

phosphorous-containing compounds such as (poly)phosphates and phosphonates;

acetylenic alcohols such as propargylic (propargyl) alcohol, pent-4-yn-1-ol, hexynol, ethyl octynol, octynol, 3-phenyl-2-propyn-1-ol;

aldehydes (other than cinnamaldehydes above) such as crotonaldehyde and aromatic aldehydes such as furfural and p-anisaldehyde;

phenones including alkenyl phenone such as β-hydroxypropiophenone, phenyl vinyl ketone, and β-ethylphenylketocyclohexyl amino hydrochloride (including those phenones and blends described in US20170233872A1, incorporated herein by reference in its entirety), e.g., commercial corrosion inhibitor blends of β-(ethyl phenyl keto cyclohexyl) amino hydrochloride, formaldehyde, cinnamaldehyde, and methanol;

nitrogen-containing heterocycles (other than the benzimidazole compound, the pyridine compound, the cyclic thiourea compound, the imidazoline compound, and urotropin described previously) such as piperazine;

quaternized heteroarenes (e.g., 1-(benzyl)quinolinium chloride);

condensation products of carbonyls and amines (e.g., Schiff bases);

sulfur containing compounds (other than the thiourea compound described above) such as thiocarbamides, mercapto amino acids, esters, or peptides, and thioglycols;

as well as mixtures thereof.

In preferred embodiments, the corrosion inhibitor composition is substantially free of supplemental corrosion inhibitors, more preferably substantially free of phenone-based corrosion inhibitors.

Making the Corrosion Inhibitor Composition

One suitable method for making the corrosion inhibitor composition will now be described, although it should be understood that many other methods, variations, and process equipment may utilized, which are generally known to those of ordinary skill in the art, and the corrosion inhibitor composition may still function as intended.

Briefly, the base fluid may be provided or prepared having an acceptable w/w ratio of the organic acid to the alcohol as described above. Next each of the date palm leaves extract, the benzimidazole compound having at least one a carbamate group, the pyridine compound, the thiourea compound, the cinnamaldehyde compound, the metal iodide, urotropin, as well as any supplemental corrosion inhibitor to be included may be mixed with the base fluid in any order, until complete dissolution, with optional agitation such as swirling, stirring, or sonication, thereby providing the corrosion inhibitor composition.

Methods of Inhibiting Corrosion

Scale deposits are formed by the precipitation and crystal growth of solid salts, oxides and hydroxides at a surface in contact with fluids containing such salts/oxides/hydroxides. In industrial fluids, such as produced waters in oil and gas extraction, process waters in mineral processing, and saline water such as sea water in desalination processes, alkaline earth metal cations or transition metals cations are generally present, including calcium, barium, and magnesium, along with their anion counterparts, including bicarbonate, carbonate, sulfate, phosphate, and silicate. Precipitation of these ions occurs when solubility is exceeded either in the bulk fluid or at the interface between a solid surface and the bulk fluid, or where high levels of dissolved solids are present, and particularly at the surfaces where heat transfer occurs such as on heat exchanger tubes, and utility steam condensers.

Many industrial processes suffer from scale formation and/or other unwanted deposits, with specific mention being made to desalination systems, cooling water systems, chemical process industries, production plants, mining, mineral processing, refineries, energy and geothermal, oil and gas exploration and production, utility industries, pulp and paper processing, food and beverage processing (e.g., molasses transport), and coal slurry transport processes. For example, mineral leaching equipment (e.g., carbon in leach circuits, tank leaching, carbon in pulp circuits, etc.), pressure oxidation equipment, flotation devices, thickener overflow and sedimentation basins, oil and gas production and transportation pipelines, and desalination heat exchange equipment are all known to experience issues with scale buildup. Scale deposits may be of particular concern when formed on heat transfer equipment, such as heat exchangers, and utility steam condensers, since scale has been shown to reduce the heat transfer efficiency of such equipment (U.S. Pat. No. 4,454,046, incorporated herein by reference in its entirety), leading to increased cleaning costs and equipment damage and/or failure. These problems ultimately cause losses in production, increased operating costs and increased capital equipment expenditures.

To remove scale buildup, the industry often turns to acidic treatment fluids for removing scale. However, the use of such acidic treatments may have the unintended drawback of causing metal corrosion.

Therefore, the present disclosure relates to a method of inhibiting corrosion of metal during acid cleaning operations, for example acid cleaning operations to remove scale deposits from desalination equipment. The method involves treating the metal with an acidic treatment fluid that contains an acid and the corrosion inhibitor composition for the dual purpose of removing scale and/or other unwanted deposits from the metal surface while simultaneously guarding that metal surface against corrosion.

The acidic treatment fluid may be useful for removing various types of scale including, but not limited to, calcium carbonate, calcium sulfate, calcium phosphate, barium sulfate, barium carbonate, magnesium hydroxide, strontium sulfate, strontium carbonate, iron sulfide, iron oxides, iron carbonate, colloidal silica (polymerized silica particles), and mixtures thereof, as well as the various silicate, phosphate, and/or oxide variants of any of the above, or any scale formed from any combination of cations and anions listed above, or any of a number of compounds insoluble or slightly soluble in water, with specific mention being made to calcium carbonate and magnesium hydroxide scales common to desalination processes. In some embodiments, the methods herein are employed for combating mixed scales.

Acidic Treatment Fluid

The acidic treatment fluid of the present disclosure generally contains an acid and the corrosion inhibitor composition.

The acidic treatment fluid may contain a variety of acids, preferably water-soluble acids. Suitable acids include, but are not limited to, hydrochloric acid, formic acid, acetic acid, chloroacetic acid, hydrofluoric acid, sulfuric acid, sulfamic acid, as well as mixtures thereof, for example mud acid (mixtures of HCl and HF). In preferred embodiments, the acid is hydrochloric acid (HCl). Typically, the acidic treatment fluid contains 0.5 to 10 wt. % of the acid, preferably 1 to 5 wt. % of the acid, preferably 1.5 to 4.5 wt. % of the acid, preferably 2 to 4 wt. % of the acid, preferably 2.5 to 3.5 wt. % of the acid, preferably 3 wt. % of the acid, based on a total weight of the acidic treatment fluid, although more concentrated or dilute versions may also be used in some circumstances.

In some embodiments, the acidic treatment fluid is formed from acidified fresh water sources, such as distilled water, tap water, well water, purified water, or fresh water obtained from natural sources such as lakes, streams, rivers. In some embodiments, the acidic treatment fluid is formed from wastewater, which may be fresh wastewater or salt-containing wastewater. As used herein, "wastewater" means a water source obtained from storm drains, sedimentation ponds, runoff/outflow, landfills, as well as water sources resulting/obtained from industrial processes such as factories, mills, farms, mines, quarries, desalination plants, industrial drilling operations, oil and gas recovery operations, papermaking processes, food preparation processes, phase separation processes, washing processes, waste treatment plants, toilet processes, power stations, incinerators, spraying and painting, or any other manufacturing or commercial enterprise, which comprises water and one or more compounds or materials derived from such industrial processes, including partially treated water from these sources.

In some embodiments, the acidic treatment fluid is formed from seawater (i.e., the acidic treatment fluid is acidified seawater). The acidified seawater may have a total dissolved solids content of up to 50,000 ppm, preferably up to 45,000 ppm, for example, 30,000 to 40,000 ppm, preferably 31,000 to 39,000 ppm, preferably 32,000 to 38,000 ppm, preferably 33,000 to 37,000 ppm, preferably 34,000 to 36,000 ppm, preferably 35,000 ppm.

When the acidic treatment fluid contains salts, such as when acidified seawater is employed, representative examples of cations which may be optionally present in the acidic treatment fluid include, but are not limited to, sodium, potassium, magnesium, calcium, strontium, barium, iron (ferrous and ferric), lead, copper, cobalt, manganese, nickel, zinc, aluminum, chromium, and titanium, as well as mixtures thereof. Representative examples of anions which may be present in the acidic treatment fluid include, but are not limited to, chloride, carbonate, bicarbonate, sulfate, bromide, iodide, acetate, hydroxide, sulfide, hydrosulfide, chlorate, fluoride, hypochlorite, nitrate, nitrite, perchlorate, peroxide, phosphate, phosphite, sulfite, hydrogen phosphate, hydrogen sulfate, as well as mixtures thereof.

Various amounts of the corrosion inhibitor composition may be employed in the disclosed methods for effective corrosion inhibition. Typically, the corrosion inhibitor composition is present in the acidic treatment fluid in an amount of 0.1 to 5 vol. %, preferably 0.2 to 4 vol. %, preferably 0.3 to 3 vol. %, preferably 0.4 to 2 vol. %, preferably 0.5 to 1.5 vol. %, preferably 0.6 to 1.2 vol. %, preferably 0.8 to 1 vol. %, based on a total volume of the acidic treatment fluid.

The acidic treatment fluid may also optionally include one or more of an intensifier, a surfactant, a supplemental antiscalant, a supplemental corrosion inhibitor, and an additive.

Surfactant

The acidic treatment fluid may optionally include one or more surfactants. Surfactants may be employed, for example, when the process equipment to be treated during the acid cleaning operation is fouled with an oily residue or coating. The surfactant(s), when present, may be included in an amount of 0.001 to 5%, preferably 0.005 to 3%, preferably 0.01 to 1%, preferably 0.1 to 0.5%, preferably 0.2 to 0.4% by weight based on a total volume of the acidic treatment fluid. Cationic, anionic, non-ionic, and/or amphoteric surfactants may be employed herein.

Cationic surfactants may include, but are not limited to

- a protonated amine formed from a reaction between a $C_6$-$C_{26}$ alkyl amine compound and an acid (e.g., acetic acid, formic acid, propionic acid, butyric acid, pentanoic acid, hexanoic acid, oxalic acid, malonic acid, lactic acid, glyceric acid, glycolic acid, malic acid, citric acid, benzoic acid, p-toluenesulfonic acid, trifluoromethanesulfonic acid, hydrochloric acid, nitric acid, phosphoric acid, sulfuric acid, hydrobromic acid, perchloric acid, hydroiodic acid, etc.), such as protonated salts of $C_6$-$C_{26}$ alkyl monoamines, $C_6$-$C_{26}$ alkyl (poly)alkylene polyamines, and alkoxylated fatty amines;
- a protonated $C_6$-$C_{26}$ alkyl amidoamine formed from a reaction between a $C_6$-$C_{26}$ alkyl amidoamine compound and an acid (for example the acids listed above), such as protonated forms of the amide reaction product between any fatty acid previously listed (or ester derivative thereof) with a polyamine (e.g., putrescine, cadaverine, ethylene diamine, $N^1$,$N^1$-dimethylethane-1,2-diamine, $N^1$,$N^1$-dimethylpropane-1,3-diamine, $N^1$,$N^1$-diethylethane-1,2-diamine, $N^1$,$N^1$-diethylpropane-1,3-diamine, spermidine, 1,1,1-tris(aminomethyl) ethane, tris(2-aminoethyl)amine, spermine, TEPA, DETA, TETA, AEEA, PEHA, HEHA, dipropylene triamine, tripropylene tetramine, tetrapropylene pentamine, pentapropylene hexamine, hexapropylene heptamine, dibutylene triamine, tributylene tetramine, tetrabutylene pentamine, pentabutylene hexamine, hexabutylene heptamine), with specific mention being made to protonated forms of stearamidopropyldimethylamine, stearamidopropyldiethylamine, stearamidoethyldiethylamine, stearamidoethyldimethylamine, palmitamidopropyldimethylamine, palmitamidopropyldiethylamine, palmitamidoethyldiethylamine, palmitamidoethyldimethylamine, behenamidopropyldimethylamine, behenamidopropyldiethylmine, behenamidoethyldiethylamine, behenamidoethyldimethylamine, arachidamidopropyldimethylamine, arachidamidopropyldiethylamine, arachidamidoethyldiethylamine, and arachidamidoethyldimethylamine; and a quaternary ammonium compound made from alkylation with suitable alkylating agents (e.g., dimethyl sulfate, methyl chloride or bromide, benzyl chloride or bromide, $C_6$-$C_{26}$ alkyl chloride or bromide, etc.) of a tertiary $C_6$-$C_{26}$ alkyl amine, an alkoxylated (tertiary) amine, or an aprotic nitrogenous heteroarene (optionally substituted) having at least one aromatic nitrogen atom with a reactive lone pair of electrons, with specific mention being made to a $C_{10}$-$C_{18}$ alkyl trimethyl ammonium chloride or methosulfate, a di-$C_{10}$-$C_{18}$ alkyl dimethyl ammonium chloride or methesulfate, a $C_{10}$-$C_{18}$ alkyl benzyl dimethyl ammonium chloride, a methyl quaternized $C_6$-$C_{22}$ alkyl propylene diamine, a methyl quaternized $C_6$-$C_{22}$ alkyl propylene triamine, a methyl quaternized $C_6$-$C_{22}$ alkyl propylene tetraamine, a N—$C_{10}$-$C_{18}$ alkyl pyridinium or a quinolinium bromide or chloride such as N-octyl pyridinium bromide, N-nonyl pyridinium bromide, N-decyl pyridinium bromide, N-dodecyl pyridinium bromide, N-tetradecyl pyridinium bromide, N-dodecyl pyridinium chloride, N-cyclohexyl pyridinium bromide, naphthyl methyl quinolinium chloride, naphthyl methyl pyridinium chloride, and cetylpyridinium chloride;

as well as mixtures thereof.

Anionic surfactants may include, but are not limited to:

sulfates, such as alkyl sulfates, alkyl-ester-sulfates, alkyl ether sulfates, alkyl-alkoxy-ester-sulfate, sulfated alkanolamides, glyceride sulfates, in particular, sulfates of fatty alcohols or polyoxyalkylene ethers of fatty alcohols such as sodium dodecyl sulfate, sodium laureth sulfate, ammonium lauryl sulfate, potassium lauryl sulfate, sodium myreth sulfate;

sulfonates such as dodecyl benzene sulfonate, lower alkyl-benzene sulfonates, alpha olefin sulfonates, lignosulfonates, sulfo-carboxylic compounds;

phosphates of fatty alcohols or polyoxyalkylene ethers of fatty alcohols such as cetyl phosphate salts, dicetyl phosphate salts, ceteth-10-phosphate salts;

carboxylate salts of fatty acids, acylamino acids, lactylates, and/or fatty alcohols/polyoxyalkylene ethers of fatty alcohols such as sodium stearate, sodium behenoyl lactylate, sodium isostearoyl lactylate, sodium caproyl lactylate, sodium laureth-5 carboxylate, sodium laureth-6 carboxylate, sodium laureth-11 carboxylate;

and mixtures thereof.

Non-ionic surfactants may include, but are not limited to:

alkanolamides of fatty acids, that is, amide reaction products between a fatty acid and an alkanolamine compound, such as coconut fatty acid monoethanolamide (e.g., N-methyl coco fatty ethanol amide), coconut fatty acid diethanolamide, oleic acid diethanolamide, and vegetable oil fatty acid diethanolamide;

alkoxylated alkanolamides of fatty acids, preferably ethoxylated and/or propoxylated variants of the alkanolamides of fatty acids using for example anywhere from 2 to 30 EO and/or PO molar equivalents, preferably 3 to 15 EO and/or PO molar equivalents, preferably 4 to 10 EO and/or PO molar equivalents, preferably 5 to 8 EO and/or PO molar equivalents per moles of the alkanolamide of the fatty acid (e.g., coconut fatty acid monoethanolamide with 4 moles of ethylene oxide);

amine oxides, such as N-cocoamidopropyl dimethyl amine oxide and dimethyl $C_6$-$C_{22}$ alkyl amine oxide (e.g., dimethyl coco amine oxide);

fatty esters, such as ethoxylated and/or propoxylated fatty acids (e.g., castor oil with 2 to 40 moles of ethylene oxide), alkoxylated glycerides (e.g., PEG-24 glyceryl monostearate), glycol esters and derivatives, monoglycerides, polyglyceryl esters, esters of polyalcohols, and sorbitan/sorbitol esters;

ethers, such as (i) alkoxylated $C_1$-$C_{22}$ alkanols, which may include alkoxylated $C_1$-$C_5$ alkanols, preferably ethoxylated or propoxylated $C_1$-$C_5$ alkanols (e.g., dipropylene glycol n-butyl ether, tripropylene glycol n-butyl ether, dipropylene glycol methyl ether, tripropylene glycol methyl ether, diethylene glycol n-butyl ether, triethylene glycol n-butyl ether, diethylene glycol methyl ether, triethylene glycol methyl ether) and alkoxylated $C_6$-$C_{26}$ alkanols (including alkoxylated fatty alcohols), preferably alkoxylated $C_7$-$C_{22}$ alkanols, more preferably alkoxylated $C_8$-$C_{14}$ alkanols, preferably ethoxylated or propoxylated (e.g., cetyl stearyl alcohol with 2 to 40 moles of ethylene oxide, lauric alcohol with 2 to 40 moles of ethylene oxide, oleic alcohol with 2 to 40 moles of ethylene oxide, ethoxylated lanoline derivatives, laureth-3, ceteareth-6, ceteareth-11, ceteareth-15, ceteareth-16, ceteareth-17, ceteareth-18, ceteareth-20, ceteareth-23, ceteareth-25, ceteareth-27, ceteareth-28, ceteareth-30, isoceteth-20, laureth-9/myreth-9, and PPG-3 caprylyl ether); (ii) alkoxylated polysiloxanes; (iii) ethylene oxide/propylene oxide copolymers (e.g., PPG-1-PEG-9-lauryl glycol ether, PPG-12-buteth-16, PPG-3-buteth-5, PPG-5-buteth-7, PPG-7-buteth-10, PPG-9-buteth-12, PPG-12-buteth-16, PPG-15-buteth-20, PPG-20-buteth-30, PPG-28-buteth-35, and PPG-33-buteth-45); and (iv) alkoxylated alkylphenols;

and mixtures thereof.

Amphoteric surfactants may include, but are not limited to:

$C_6$-$C_{22}$ alkyl dialkyl betaines, such as fatty dimethyl betaines ($R—N(CH_3)_2(^+)—CH_2COO^-$), obtained from a $C_6$-$C_{22}$ alkyl dimethyl amine which is reacted with a monohaloacetate salt (e.g., sodium monochloroacetate), such as $C_{12}$-$C_{14}$ dimethyl betaine (carboxylate methyl $C_{12}$-$C_{14}$ alkyl dimethylammonium);

$C_6$-$C_{22}$ alkyl amido betaines ($R—CO—NH—CH_2CH_2CH_2—N(CH_3)_2(^+)—CH_2COO^-$ or $R—CO—NH—CH_2CH_2—N(CH_3)_2(^+)—CH_2COO^-$), obtained by the reaction of a monohaloacetate salt (e.g., sodium monochloroacetate) with the reaction product of either dimethyl amino propylamine or dimethyl amino ethylamine with a suitable carboxylic acid or ester derivatives thereof, such as $C_{10}$-$C_{18}$ amidopropyl dimethylamino betaine;

$C_6$-$C_{22}$ alkyl sultaines or $C_6$-$C_{22}$ alkyl amido sultaines, which are similar to those $C_6$-$C_{22}$ alkyl dialkyl betaines or $C_6$-$C_{22}$ alkyl amido betaines described above except in which the carboxylic group has been substituted by a sulfonic group ($R—N(CH_3)_2(^+)—CH_2CH_2CH_2SO_3^-$ or $R—CO—NH—CH_2CH_2CH_2—N(CH_3)_2(^+)—CH_2CH_2CH_2SO_3^-$ or $R—CO—NH—CH_2CH_2—N(CH_3)_2(^+)—CH_2CH_2CH_2SO_3^-$) or a hydroxysulfonic group ($R—N(CH_3)_2(^+)—CH_2CH(OH)—CH_2SO_3^-$ or $R—CO—NH—CH_2CH_2CH_2—N(CH_3)_2(^+)—CH_2CH(OH)—CH_2SO_3^-$ or $R—CO—NH—CH_2CH_2—N(CH_3)_2(^+)—CH_2CH(OH)—CH_2SO_3^-$), such as $C_{10}$-$C_{18}$ dimethyl hydroxysultaine and $C_{10}$-$C_{18}$ amido propyl dimethylamino hydroxysultaine;

and mixtures thereof.

In some embodiments, the acidic treatment fluid is substantially free of a surfactant.

Supplemental Antiscalant

In some embodiments, in addition to the acid(s), the acidic treatment fluid may also optionally include one or more supplemental antiscalants, which is a term used herein to define any substance/compound which imparts or is expected to impart a material antiscalant or scale removal effect when included in the acidic treatment fluid, other than the acid (e.g., HCl) present. Such supplemental antiscalants may be classified as chelants and/or dispersants, and include, but are not limited to:

phosphate esters; such as those made from blends of polyphosphoric acid (PPA) and/or $P_2O_5$ with hydroxyamines, e.g., ethanolamine, N-methylethanolamine, N,N-dimethylethanolamine, N-ethylethanolamine, N-propylethanolamine, N-isopropylethanolamine, N,N-diisopropylethanolamine, N-butylethanolamine, diethanolamine, N-methyldiethanolamine, N-ethyldiethanolamine, triethanolamine (TEA), propanolamine (3-Amino-1-propanol), N-methylpropanolamine, N,N-dimethylpropanolamine, dipropanolamine, tripropanolamine, isopropanolamine, N,N-dimethylisopropanolamine, diisopropanolamine, triisopropanolamine, 2-amino-2-methyl-1-propanol, 2-amino-2-ethyl-1,3-propanediol, 4-amino-1-butanol, 2-amino-1-butanol, sec-butanolamine, di-sec-butanolamine, and bishydroxyethylethylene diamine, for example, DANOX SC-100, available from Kao, Inc., which is a 70% by weight active composition of a phosphate ester formed from TEA/PPA; as well as phosphate esters of PPA and/or $P_2O_5$ with hydroxyamines formed by alkoxylation of a primary or secondary amines, for example, alkoxylates of diethylenetriamine (DETA), triethylenetetraamine (TETA), and/or tetraethylenepentaamine (TEPA), for example as described in U.S. Pat. No. 3,477,956A—incorporated herein by reference in its entirety;

organic polymers, preferably polymers based on non-ionic monomers, anionic monomers, or mixtures thereof, including, but not limited to, polymaleates (e.g., homopolymers of maleic acid (HPMA)), polyacrylates (e.g., acylic acid homopolymer (PAA or HAA), sodium acrylate homopolymer), polymethacrylates, polyacrylamides, polysaccharides including modified polysaccharides (e.g., carboxymethyl inulin), amino acid-based polymers (e.g., polyaspartic acid (PASP) homopolymer and salts thereof), polyethers (e.g., polymers based on polymerization of EO, PO, and/or BO, such as those described in WO2015/195319A1—incorporated herein by reference in its entirety), polymers based on sulfonated monomers such as 2-acrylamido-2-methylpropane sulfonic acid (AMPS), vinylsulfonates (e.g., vinylsulfonic acid and salts thereof), styrene sulfonates, etc.; including modified versions of such polymers as well as blends thereof or copolymers made from two or more types of monomers, for example, maleic acid copolymers, maleic acid terpolymers, sulfonic acid copolymers (SPOCA), sulfonated polyacrylic acid copolymers, modified polyacrylic acids, carboxylate sulfonate copolymers, acrylic acid (AA)/AMPS copolymers, AA/AMPS/non-ionic monomer terpolymers (e.g., AA/AMPS/polyacrylamide terpolymer), carboxylate/sulfonate/maleic acid (MA) terpolymer, AA/MA copolymer (CPMA), sulfonated styrene/MA copolymer, AA/acrylamide copolymer, AMPS/N,N-dimethylacrylamide copolymer, phosphino carboxylic acid (PCA) polymers (e.g., phosphinopolyacrylate), sulfonated phosphino carboxylic acid copolymer (such as BELLASOL S-50 from BWA Water Additives and DREWSPERSE 6980 available from Solenis), partially hydrolyzed polyacrylamide, polyether phosphonic acids (e.g., polyamino polyether methylene phosphonic acid (PAPEMP));

phosphonates; such as aminotris(methylenephosphonic acid) (ATMP), phosphoisobutane tricarboxylic acid (PBTC), 1-hydroxyethylidene diphosphonic acid (HEDP), hexamethylenediamine tetramethylene phosphonic acid (HMDT or HMDTMPA), diethylenetriamine penta(methylenephosphonic acid) (DTPMP), bis(hexamethylene) triamine penta (methylene phosphonic) acid (BHPMP), bis(hexamethylene) triamine pentabis(methylene phosphonic acid) (HMTPMP), pentaethylene hexaamineoctakis (methylene phosphonic acid) (PEHOMP); including aminophosphonates of ethanolamine, ammonia, ethylene diamine, bishydroxyethylene diamine, bisaminoethylether, diethylenetriamine, hexamethylene diamine, hyperhomologues and isomers of hexamethylene diamine, polyamines of ethylene diamine and diethylene tetraamine, diglycolamine and homologues, or similar polyamines or mixtures or combinations thereof;

carboxylate-containing chelating agents (non-polymeric) such as ethylene diamine tetraacetic acid (EDTA), diethylene triamine pentaacetic acid (DPTA), hydroxyethylene diamine triacetic acid (HEDTA), ethylene diamine di-ortho-hydroxy-phenyl acetic acid (EDDHA), ethylene diamine di-ortho-hydroxy-para-methyl phenyl acetic acid (EDDHIMA), ethylene diamine di-ortho-hydroxy-para-carboxy-phenyl acetic acid (EDDCHA), nitrolotriacetic acid (NTA), thioglycolic acid (TGA), hydroxyacetic acid, citric acid, tartaric acid, as well as the sodium, potassium, and/or ammonium salts thereof;

including mixtures thereof.

When present, the concentration of the one or more other supplemental antiscalants in the acidic treatment fluids may be from 0.1 to 10 wt. %, preferably 0.5 to 8 wt. %, preferably 1 to 6 wt. %, preferably 2 to 4 wt. %, preferably 3 wt. %, based on a total weight of the acidic treatment fluid.

Additives

The acidic treatment fluids may optionally further include one or more additives to modify the properties or functions of the acidic treatment fluid, as needed. Typically, when present, the additive(s) may be incorporated in an amount of less than 10 wt. %, preferably less than 8 wt. %, preferably less than 6 wt. %, preferably less than 4 wt. %, preferably less than 2 wt. %, preferably less than 1 wt. %, preferably less than 0.5 wt. %, preferably less than 0.1 wt. %, based on a total weight of the acidic treatment fluid.

Exemplary additive(s) may include, but are not limited to, stabilizing agents e.g., polypropylene glycol, polyethylene glycol, polysiloxane polyalkyl polyether copolymers, acrylic copolymers, carboxyvinyl polymers, polyvinylpyrollidones, polyacrylates;

dispersing agents e.g., polymeric or co-polymeric compounds of polyacrylic acid, polyacrylic acid/maleic acid copolymers, styrene/maleic anhydride copolymers, polymethacrylic acid, and polyaspartic acid;

defoaming agents e.g., silicone oils, silicone oil emulsions, organic defoamers, emulsions of organic defoamers, silicone-organic emulsions, silicone-glycol compounds, silicone/silica adducts, emulsions of silicone/silica adducts;

as well as mixtures thereof.

In some embodiments, the acidic treatment fluid is substantially free of an additive.

The methods herein inhibit corrosion of metal surfaces during acid cleaning, preferably during acid cleaning of a desalination system. The desalination system may be used for primary desalination (usually thermal driven process) and/or a secondary desalination process (usually a pressure driven process involving the use of membranes). The desalination system may be a multi-stage flash (MSF) desalination plant, a multiple effect distillation (MED) plant, a vapor-compression (VC) distillation plant, a geothermal desalination plant, a solar desalination system (e.g., multiple-effect humidification (MEH) system), or any other thermally driven desalination system known to those of ordinary skill in the art.

Any metal surface that is susceptible to the formation of scale can be treated by the methods disclosed herein, including, but not limited to, separation vessels, pipelines, valves, spools, fittings, storage tanks, heat exchangers (e.g., coils of heat exchangers), pump parts, casings, liners, screens, and utility steam condensers, with specific mention being made to the surfaces of heat exchangers (e.g., heat exchanger tubes/coils) and utility steam condensers of desalination plants (e.g., multi-stage flash desalination plant). In preferred embodiments, the acidic treatment fluid is used to remove scale from and to simultaneously prevent corrosion of any metal parts present in/on the part(s) being treated.

Although certain metals may respond differently, any metal surface that may come into contact with the acidic treatment fluid may be protected by the corrosion inhibitor composition of the present disclosure. Examples of such metals include, but is not limited to, titanium and titanium alloys, carbon steels (e.g., mild steels, high-tensile steels, higher-carbon steels); high alloy steels including chrome steels, ferritic alloy steels, austenitic stainless steels, precipitation-hardened stainless steels, high nickel content steels such as those which contain 14 to 25 percent nickel (e.g., Ni-Resist); galvanized steel, aluminum, aluminum alloys, copper, copper nickel alloys, copper zinc alloys, brass, ferritic alloy steels, and any combination thereof. In some embodiments, the metal is a ferrous-based alloy, for example, a ferrous-based alloy which contains at least 70 wt. %, preferably at least 80 wt. %, preferably at least 85 wt. %, preferably at least 90 wt. %, preferably at least 93 wt. %, preferably at least 95 wt. %, preferably at least 97 wt. %, preferably at least 99 wt. %, preferably at least 99.5 wt. % Fe, and which can also include up to 30 wt. %, preferably up to 20 wt. %, preferably up to 10 wt. %, preferably up to 7 wt. %, preferably up to 5 wt. %, preferably up to 3 wt. %, preferably up to 1 wt. %, of such other metals as C, Cr, Mn, Ni, W, B, Ti, Al, V, Mo, Co, Nb, Pd, Pt, Zr, Cb, Ta, and the like.

Preferred metals include, but are not limited to, carbon steel, low carbon steel, mild steel, medium carbon steel, high carbon steel, alloy steel, stainless steel, austenitic steel, ferritic steel, martensitic steel, tool steel, Ni-Resist, or mixtures thereof. Specific examples may include, but are not limited to, mild steels with a carbon content of up to 0.3%, preferably 0.1 to 0.25%, preferably 0.15 to 0.2%, for example, 1018 (e.g. AISI 1018), ASTM A36, 12L14, ASTM A653, other carbon steel alloys such as A366/1008, A513 (alloy 1020-1026), C1020 steel, and 8620 alloy, stainless steels such as 304, 316L, 409, and 430 grade stainless steel, and Ni-Resist such as Ni-Resist 201 (Type 1) and Ni-Resist 202 (Type 2), for example ASTM A436 grade D-2 and D-5B.

In some embodiments, the acidic treatment fluid is pre-formed by combining the acid (aq.), the corrosion inhibitor composition, and any optional components, followed by introducing the pre-formed acidic treatment fluid into an appropriate location in need of descaling, for example, inside the heat exchanger tubing of a desalination plant. In some embodiments, the acid (aq.) and the corrosion inhibitor composition (and any optional components) are introduced as separate streams, combining at the location to be descaled to form the acidic treatment fluid for acid cleaning. The corrosion inhibitor composition may be injected before, after, or simultaneously with the acid (aq.) for use in the acid cleaning process.

The acidic treatment fluid may be introduced for acid cleaning treatment using any technique known to those of ordinary skill in the art. For example, the acidic treatment fluid may be injected through suitable injection lines to areas where acid cleaning is desired, cycled through the plant being treated as an influent stream, or used as a soak. Treatment may be performed manually or it may be automatic, for example, by using chemical injection pumps. In some embodiments, the acidic treatment fluid may be stored in a chemical storage tank and a chemical injection pump associated therewith may be used to introduce the acidic treatment fluid into the desired location of the operation. In any of the above applications, the acidic treatment fluid may be introduced continuously and/or in batches. The treatment may be carried out by using inline static mixers, inline mixers with velocity gradient control, inline mechanical mixers with variable speed impellers, inline jet mixers, motorized mixers, batch equipment, and appropriate chemical injection pumps and/or metering systems, just to name a few. The treatment can be automatically or manually controlled to add any amount of the acidic treatment fluid needed for adequate descaling/cleaning.

In some embodiments, the metal is treated with the acidic treatment fluid under static conditions, that is, the metal (having the scale deposit) may be in contact with a substantially stationary body of the scale inhibitor composition (e.g., soaking methods). In alternative embodiments, the metal is treated with the acidic treatment fluid under hydrodynamic conditions, whereby the metal may be brought into contact with the acidic treatment fluid that is in a flowing state, for example, where a stream of the acidic treatment fluid is jetted/impinged onto the surface having the scale deposit, or where a stream of the acidic treatment fluid is flowed or passed over the surface having the scale deposit. For example, when the surface having the scale deposit is an inside surface of a heat exchanger coil, the acidic treatment fluid may be flowed or passed through the heat exchanger coil in a direction substantially parallel to the longitudinal axis of the coil. Typically, the acidic treatment fluid may be flowed or passed over the surface having the scale deposit at a flow rate of 0.1 to 10 m/s, preferably 0.5 to 5 m/s, preferably 1 to 3 m/s, preferably 1.5 to 2 m/s, although flow rates above or below these ranges may also be used when appropriate.

The metal may be treated with the acidic treatment fluid at a variety of temperatures to effect scale removal, and, even at elevated temperatures, the corrosion inhibitor composition present in the acidic treatment fluid remains effective at preventing corrosion from occurring to that metal surface. For example, the metal may be treated with the acidic treatment fluid at a temperature of 20 to 100° C., preferably 30 to 80° C., preferably 40 to 70° C., preferably 50 to 60° C.

Corrosion rate is the speed at which metals undergo deterioration. Corrosion rate may be measured according to the American Society for Testing and Materials (ASTM) standard weight loss (immersion) test ASTM G-31, or using electrochemical methods according to ASTM G59-97, such as linear polarization resistance (LPR) and potentiodynamic polaraization (PDP), as described in the Examples. The corrosion rate may be expressed using millimeters per year (mm/y). In some embodiments, the method provides a corrosion rate of less than 0.9 mm/y, preferably less than 0.85 mm/y, preferably less than 0.8 mm/y, preferably less than 0.75 mm/y, preferably less than 0.7 mm/y, preferably less than 0.65 mm/y, preferably less than 0.6 mm/y, preferably less than 0.55 mm/y, preferably less than 0.5 mm/y, preferably less than 0.45 mm/y, preferably less than 0.4 mm/y, preferably less than 0.35 mm/y, preferably less than 0.3 mm/y, preferably less than 0.25 mm/y, preferably less than 0.2 mm/y, preferably less than 0.15 mm/y, preferably less than 0.1 mm/y, preferably less than 0.05 mm/y, when the metal is contacted with the acidic treatment fluids for a time period of up to 72 hours, preferably up to 48 hours, preferably up to 32 hours, preferably up to 24 hours, preferably up to 12 hours, preferably up to 6 hours, at a temperature of 20 to 40° C.

Corrosion inhibition efficiencies (IE %) may be measured by comparing the corrosion rates obtained from acidic treatment fluids with and without corrosion inhibitors using weight loss (immersion) studies, potentiodynamic polarization (PDP), linear polarization resistance (LPR) or other similar methods. In some embodiments, the method described herein achieves a corrosion inhibition efficiency of 50 to 99.5%, preferably 60 to 99%, preferably 70 to 98.5%, preferably 80 to 98%, preferably 85 to 97.5%, preferably 90 to 96% when the metal is treated with the acidic treatment fluid (e.g., at temperatures ranging from 20 to 40° C.).

The examples below are intended to further illustrate protocols for preparing and testing the corrosion inhibitor compositions in acidic treatment fluids and are not intended to limit the scope of the claims.

Where a numerical limit or range is stated herein, the endpoints are included. Also, all values and subranges within a numerical limit or range are specifically included as if explicitly written out.

As used herein the words "a" and "an" and the like carry the meaning of "one or more."

Obviously, numerous modifications and variations of the present invention are possible in light of the above teachings. It is therefore to be understood that, within the scope of the appended claims, the invention may be practiced otherwise than as specifically described herein.

All patents and other references mentioned above are incorporated in full herein by this reference, the same as if set forth at length.

EXAMPLES

Experimental

Extraction of Date Palm Leaves

Figure 3:
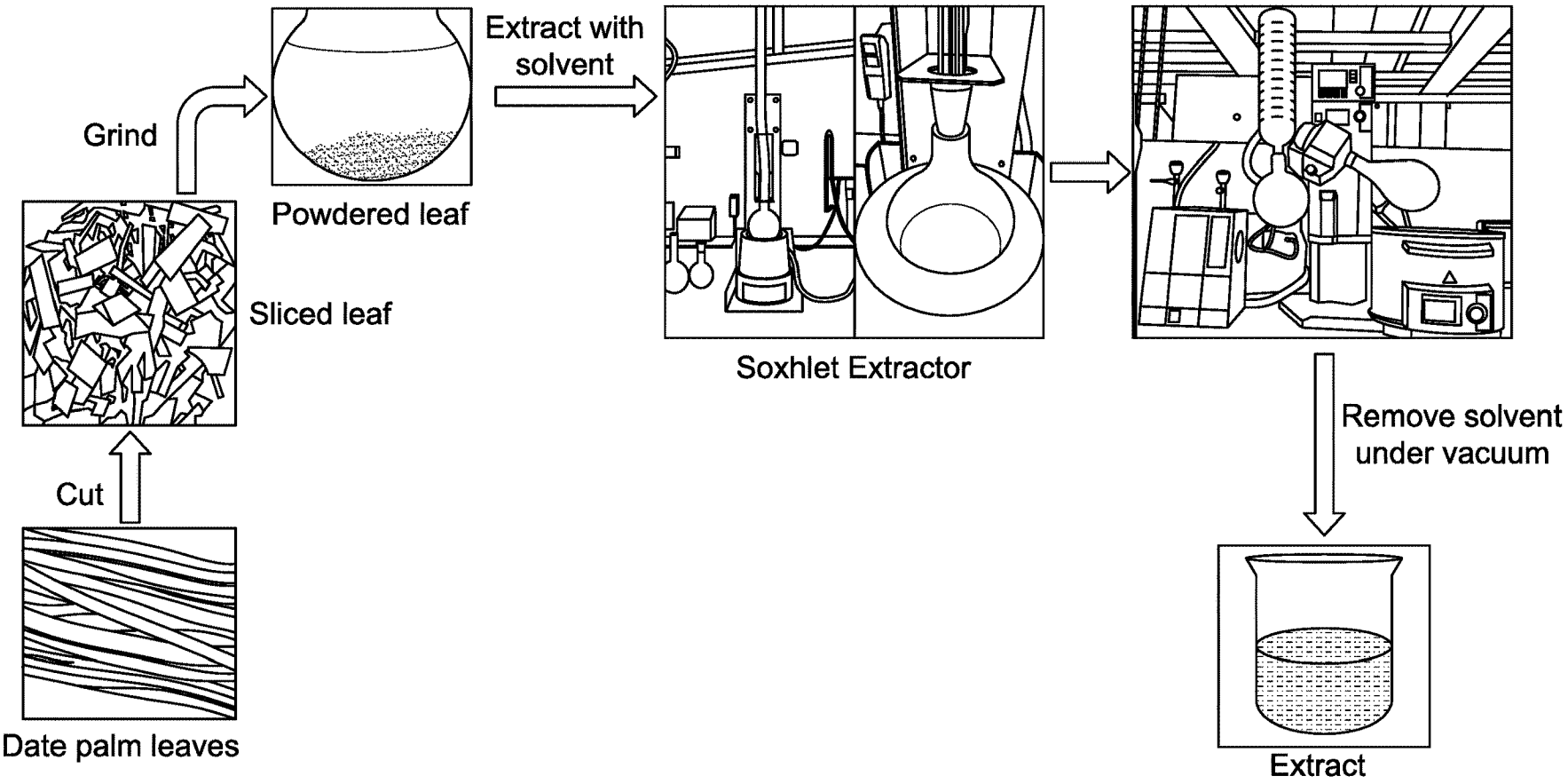
FIG. 3 is a flow diagram illustrating the procedures involved in the extraction of date palm leaves.

Fresh Date palm leaves were collected into clean plastic bags from Date palm trees growing around the King Fahd University of Petroleum and Minerals, Saudi Arabia. The leaflets were obtained and were used in this study. The leaflets were washed thoroughly with tap water and rinsed several times with distilled water. The leaves were then sun-dried for 72 h, after which the leaves were sliced into smaller pieces. The sliced pieces were ground into powder form and stored in pre-cleaned sample bottles until use. 10 g of the powdered date palm leaves were weighed into a round-bottom flask and extracted for 4 h with 500 mL of absolute ethanol at 80° C. After the extraction, a rotary evaporator operated at 65° C. was employed to concentrate the extract at 65° C. into a semi-solid form. The FIG. 3 describes the date palm leaves extraction process.

Immersion Corrosion Testing

The immersion corrosion testing was conducted on C1020 carbon steel, Ni-Resist, and 316 L stainless steel coupons in 2 wt. % HCl solution at 40° C. The water used in the preparation of the acid solution was seawater with a TDS of about 45,000 ppm. The samples were prepared by surface grinding down to 800 grit size using SiC paper followed, successively, with thorough washing using distilled water, cleaning with alcohol, acetone and distilled water, and drying with warm air. Weight loss measurement (according to ASTM-G 31) was conducted with 0.3, 0.4 and 0.5 vol. % concentration of corrosion inhibitor composition ("formulation") under static condition (after 6, 24 and 72 h exposure to the acidic solution) and hydrodynamic condition (flow rate of 1 m/s, after 24 and 72 h exposure to the acid solution). See ASTM-G 31, Standard practice of laboratory Immersion Corrosion Testing Material, ASTM Book of Standards (Reapproved 2004), incorporated herein by reference in its entirety. The metal specimens had average exposed surface area of 20 $cm^2$. The weight loss due to corrosion (WL) was calculated from Eq. (1), whereby $W_o$ and $W_1$ represent the weights of the coupons before and after corrosion, respectively. The corrosion rate (ν) in mm/yr was calculated using Eq. 2, while the inhibition efficiency (η %) of the formulation was calculated using Eq. 3. See ASTM-G 01-03, ASTM Book of Standards, West Conshohocken: ASTM, 2003, vol. 3.02, incorporated herein by reference in its entirety.

$$WL(g) = W_0 - W_1 \tag{1}$$

$$v(\text{mm/yr}) = \frac{87600 \times \overline{WL}}{\rho AT} \tag{2}$$

$$\eta\ (\%) = \frac{v_{(blank)} - v_{(inh.)}}{v_{(blank)}} \times 100 \tag{3}$$

where $\overline{WL}$=average weight loss (g), ρ=density of the test metal specimen (g $cm^{-3}$), T=immersion time (h), A=surface area of the specimen ($cm^2$), $v_{(blank)}$=corrosion rate in the uninhibited 2% HCl solution and $v_{(inh.)}$=corrosion rate in 2% HCl containing formulation. The weight loss results are detailed in Tables 2 and 3.

Electrochemical Corrosion Testing

In order to corroborate the weight loss measurements, electrochemical measurements (according to ASTM G59-

97) were conducted after 72 h exposure of the ferrous-based alloys in the 2 wt. % HCl without and with 0.4 vol. % of the formulation. See ASTM G59-97(2009), Standard Test Method for Conducting Potentiodynamic Polarization Resistance Measurements, ASTM International, West Conshohocken, 2009, incorporated herein by reference in its entirety. The tests were conducted with a Gamry 600 potentiostat. Using a conventional three-electrode glass cell, test specimens served as working electrode, a graphite electrode as counter electrode and a silver-silver chloride (Ag/AgCl) electrode as reference connected via a Lugging capillary bridge. The electrochemical methods used are linear polarization resistance (LPR) and potentiodynamic polarization (PDP). The LPR measurements were performed within −10 to +10 mV of the open circuit potential ($E_{corr}$) by applying a scan rate of 0.167 mV $s^{-1}$. The PDP measurements were performed within −250 to +250 mV/$E_{corr}$ at a scan rate of 0.2 mV $s^{-1}$ (for 1020 carbon steel and Ni-Resist), while cyclic potentiodynamic polarization was conducted for the 316L stainless steel with initial potential −250 mV/$E_{corr}$ and apex/reverse potential 1000 mV/$E_{corr}$ at scan rate of 0.2 mV $s^{-1}$. From the LPR result, the corrosion rate was expressed in mm/yr using Eq. 4 (according to ASTM G102-89) while the inhibition efficiency was deduced based on Eq. 3. See ASTM G102-89(2010), Standard Practice for Calculation of Corrosion Rates and Related Information from Electrochemical Measurements, ASTM International, West Conshohocken, 2010, incorporated herein by reference in its entirety. On the other hand, the corrosion inhibition efficiency from the PDP result was calculated using Eq. 5.

$$\upsilon(mpy) = 0.0254 \times \upsilon(\text{mm/yr}) \quad (4)$$

$$\%\ \eta_{PDP} = 1 - \frac{i_{corr(inh)}}{i_{corr(blank)}} \times 100\% \quad (5)$$

where $i_{corr(blank)}$ and $i_{corr(inh)}$ are, respectively, the corrosion current density recorded in the absence and presence of an inhibitor. The results from the electrochemical measurements are provided in FIGS. 4A-4C, Tables 4 and 5. For all corrosion testing, a well-known corrosion inhibitor (termed "commercial") was also tested in 2 wt. % HCl solutions under similar conditions for comparison with the present corrosion inhibitor composition ("formulation").

TABLE 1A

Typical composition of the corrosion inhibitor composition.

| S/N | Chemistry | Composition (wt. %) |
|---|---|---|
| 1 | Date palm leaves extract | 1-5 |
| 2 | Benzimidazole compound having at least one a carbamate group | 1-2 |
| 3 | Pyridine compound | 0.24-1 |
| 4 | Urotropin | 1.08-2 |
| 5 | Cinnamaldehyde compound | 0.02-0.2 |
| 6 | Metal iodide | 0.24-1 |
| 7 | Thiourea compound | 0.14-1.44 |
| 8 | Ethanol and formic acid | 93.13-95 |

TABLE 1B

Example corrosion inhibitor composition ("formulation") used in the Examples.

| S/N | Chemistry | Composition (wt. %) |
|---|---|---|
| 1 | Date palm leaves extract | 2.00 |
| 2 | 6-mercaptopyridine-3-carboxylic acid | 0.24 |
| 3 | Fenbendazole | 1.08 |
| 4 | Albendazole | 0.72 |
| 5 | Urotropine | 1.08 |
| 6 | Cinnamaldehyde | 0.02 |
| 7 | Potassium iodide | 0.24 |
| 8 | 1-(2-methoxyphenyl)-2-thiourea | 0.72 |
| 9 | N,N'-diphenylthiourea | 0.72 |
| 10 | Ethanol and formic acid | 93.18 |

Results and Discussion

Immersion Corrosion Results

The performances of the formulation and the commercial corrosion inhibitor against the corrosion of carbon steel, 316 L stainless steel, and Ni-resist exposed to 2 wt. % HCl solution for 6, 24, and 48 h at 40° C. under static and atmospheric conditions are shown in Table 2. Both inhibitors effectively suppressed the dissolution of the metals in the acid solution and their performances were enhanced with increased concentration. Under static conditions, the formulation of the present disclosure performs better than the commercial product in the protection of carbon steel and Ni-Resist for every inhibitor concentration and exposure time considered, although the formulation performs slightly lower than the commercial product in the case of stainless steel. At a concentration of 0.4 vol %, the formulation exhibits an optimum performance. With this concentration, the corrosion rate of all three metals decrease with increasing exposure time.

TABLE 2

Calculated values of corrosion rate and inhibition efficiency for metal substrates exposed to 2 wt. % HCl solution at 40° C. under static and atmospheric conditions with different vol % of corrosion inhibitors.

| | | Corrosion rate (mm/yr) | | | Inhibition efficiency (%) | | |
|---|---|---|---|---|---|---|---|
| Conc. | Metallurgy | 6 h | 24 h | 72 h | 6 h | 24 h | 72 h |
| Blank | 316 L | 0.2978 ± 0.0001 | 0.3220 ± 0.0013 | 1.3790 ± 0.0026 | — | — | — |
| | Ni-Resist | 0.6702 ± 0.0006 | 0.3351 ± 0.0028 | 0.2216 ± 0.0062 | — | — | — |
| | Carbon steel | 20.5320 ± 0.0022 | 12.4748 ± 0.0979 | 4.8346 ± 0.0521 | — | — | — |
| 0.3% Commercial | 316 L | 0.1368 ± 0.0000 | 0.0684 ± 0.0002 | 0.0510 ± 0.0002 | 54.05 | 78.75 | 96.30 |
| | Ni-Resist | 0.1623 ± 0.0002 | 0.0847 ± 0.0013 | 0.0841 ± 0.0013 | 75.79 | 74.74 | 62.07 |
| | Carbon steel | 0.4088 ± 0.0007 | 0.5054 ± 0.0035 | 0.3760 ± 0.0071 | 98.01 | 95.95 | 92.22 |
| 0.4% Commercial | 316 L | 0.0885 ± 0.0001 | 0.0664 ± 0.0011 | 0.0590 ± 0.0010 | 70.27 | 79.38 | 95.72 |
| | Ni-Resist | 0.1623 ± 0.0000 | 0.0847 ± 0.0009 | 0.1046 ± 0.0061 | 75.79 | 74.74 | 52.79 |
| | Carbon steel | 0.4013 ± 0.0000 | 0.3464 ± 0.0000 | 0.3937 ± 0.0044 | 98.05 | 97.22 | 91.86 |
| 0.5% Commercial | 316 L | 0.1127 ± 0.0001 | 0.0865 ± 0.0000 | 0.0550 ± 0.0009 | 62.16 | 73.13 | 96.01 |
| | Ni-Resist | 0.1623 ± 0.0000 | 0.1305 ± 0.0023 | 0.0823 ± 0.0095 | 75.79 | 61.05 | 62.86 |
| | Carbon steel | 0.4618 ± 0.0000 | 0.5035 ± 0.0006 | 0.2833 ± 0.0058 | 97.75 | 95.96 | 94.14 |

TABLE 2-continued

Calculated values of corrosion rate and inhibition efficiency for metal substrates exposed to 2 wt. % HCl solution at 40° C. under static and atmospheric conditions with different vol % of corrosion inhibitors.

| | | Corrosion rate (mm/yr) | | | Inhibition efficiency (%) | | |
|---|---|---|---|---|---|---|---|
| Conc. | Metallurgy | 6 h | 24 h | 72 h | 6 h | 24 h | 72 h |
| 0.3% Formulation | 316 L | 0.1897 ± 0.0016 | 0.0948 ± 0.0002 | 0.0824 ± 0.0004 | 36.30 | 70.56 | 94.02 |
| | Ni-Resist | 0.1919 ± 0.0000 | 0.0903 ± 0.0000 | 0.0944 ± 0.0000 | 71.37 | 73.05 | 57.40 |
| | Carbon steel | 0.3213 ± 0.0014 | 0.1508 ± 0.0000 | 0.1483 ± 0.0004 | 98.44 | 98.79 | 96.93 |
| 0.4% Formulation | 316 L | 0.1816 ± 0.0008 | 0.0989 ± 0.0000 | 0.0885 ± 0.0007 | 39.02 | 69.29 | 93.58 |
| | Ni-Resist | 0.1844 ± 0.0002 | 0.1054 ± 0.0004 | 0.0900 ± 0.0003 | 72.49 | 68.55 | 59.39 |
| | Carbon steel | 0.4456 ± 0.0004 | 0.1485 ± 0.0007 | 0.1243 ± 0.0001 | 97.83 | 98.81 | 97.43 |
| 0.5% Formulation | 316 L | 0.2300 ± 0.0014 | 0.0948 ± 0.0006 | 0.0831 ± 0.0002 | 22.77 | 70.56 | 93.97 |
| | Ni-Resist | 0.1844 ± 0.0000 | 0.0969 ± 0.0007 | 0.0897 ± 0.0009 | 72.49 | 71.08 | 59.52 |
| | Carbon steel | 0.4062 ± 0.0006 | 0.1804 ± 0.0004 | 0.1435 ± 0.0017 | 98.02 | 98.55 | 97.03 |

TABLE 3

Performance of 0.4 vol% commercial corrosion inhibitor and 0.4 vol% formulation against 316L, Ni-resist, and carbon steel corrosion in 2 wt. % HCl solution at 40° C. under hydrodynamic and atmospheric conditions

| | | Average weight loss (g) | | Corrosion rate (mm/yr) | | Inhibition efficiency (%) | |
|---|---|---|---|---|---|---|---|
| Conc. | Metallurgy | 24 h | 72 h | 24 h | 72 h | 24 h | 72 h |
| Blank | 316 L | 0.068 ± 0.007 | 0.719 ± 0.001 | 1.376 ± 0.007 | 4.837 ± 0.001 | — | — |
| | Ni-Resist | 0.521 ± 0.000 | 1.765 ± 0.009 | 9.800 ± 0.000 | 6.112 ± 0.009 | — | — |
| | Carbon steel | 1.151 ± 0.012 | 2.048 ± 0.042 | 17.620 ± 0.012 | 10.349 ± 0.042 | — | — |
| Formulation | 316 L | 0.038 ± 0.000 | 0.086 ± 0.003 | 0.761 ± 0.000 | 0.579 ± 0.003 | 44.72 | 88.03 |
| | Ni-Resist | 0.024 ± 0.000 | 0.112 ± 0.002 | 0.460 ± 0.000 | 0.699 ± 0.002 | 95.39 | 88.56 |
| | Carbon steel | 0.050 ± 0.002 | 0.103 ± 0.001 | 0.761 ± 0.002 | 0.522 ± 0.001 | 95.68 | 94.96 |
| Commercial | 316 L | 0.028 ± 0.000 | 0.040 ± 0.000 | 0.567 ± 0.000 | 0.271 ± 0.000 | 58.80 | 94.39 |
| | Ni-Resist | 0.049 ± 0.002 | 0.137 ± 0.008 | 0.919 ± 0.002 | 0.858 ± 0.008 | 90.62 | 85.96 |
| | Carbon steel | 0.045 ± 0.003 | 0.103 ± 0.002 | 1.043 ± 0.003 | 1.035 ± 0.002 | 96.09 | 94.96 |

Although hydrodynamic conditions decreased the performances of the corrosion inhibitors, relative to their performances under static conditions, the formulation of the present disclosure still competes favorably with the commercial corrosion inhibitor for all the studied metals. In fact, the formulation performed better than the commercial product in the case of Ni-resist and similar in performance in the case of carbon steel and 316L stainless steel when compared with the commercial product (Table 3).

Electrochemical Corrosion Results

Figure 4A:
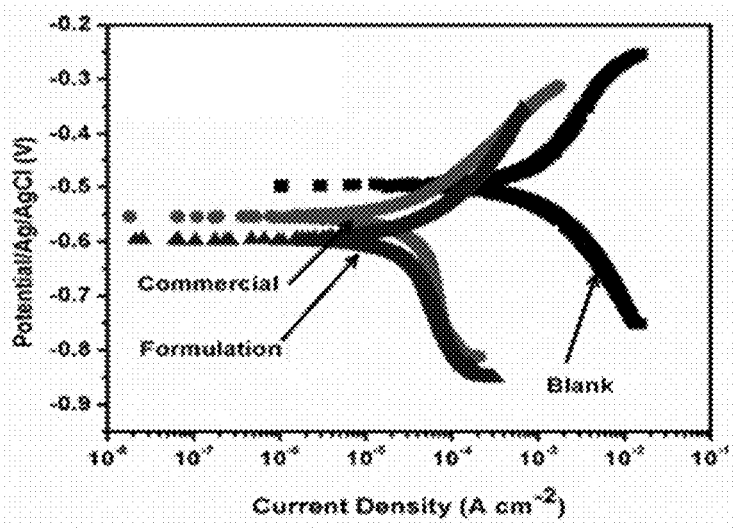
FIGS. 4A-4C are graphs illustrating the potentiodynamic polarization curves for (FIG. 4A) carbon steel (FIG. 4B) Ni-Resist and (FIG. 4C) 316L stainless steel after corrosion in an acidic treatment fluid (2 wt. % HCl solution) without corrosion inhibitor ("blank"), with the corrosion inhibitor composition ("formulation"), and with a commercial corrosion inhibitor ("commercial").
Figure 4B:
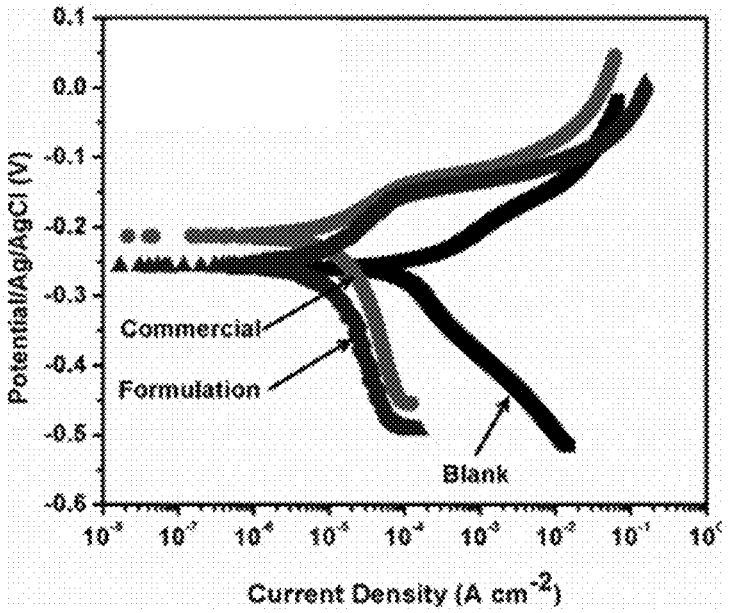

FIGS. 4A and 4B present the potentiodynamic polarization curves for carbon steel and Ni-Resist, respectively, after 72 h of immersion in 2 wt. % HCl solution without and with 0.4 vol % of the inventive formulation and the commercial corrosion inhibitor under hydrodynamic conditions (flow rate of 1 m/s). The presence of both inhibitors in the acid solution caused a remarkable decrease in the anodic and cathodic current densities, an indication of corrosion inhibition. The dominant effect is, however observed on the cathodic branch. In addition, the corrosion potential (Ecorr) is displaced in the cathodic direction. These observations show that both the inventive formulation and the commercial product act as mixed type corrosion inhibitors for carbon steel and Ni-Resist but with greater effect on cathodic half reactions. Such cathodic reaction involves hydrogen evolution process whereby hydrogen ions (H+) furnished by the acid consumes the electrons generated via the oxidative transformation of atomic iron (Fe) into aqueous cationic species (Fem). The chemistry is shown in Eq. (6 & 7).

$$2H^{+}+2e \rightarrow H_2 \text{(Cathodic)} \quad (6)$$

$$Fe \rightarrow Fe^{2+}+2e \text{(Anodic)} \quad (7)$$

The values of corrosion parameters derived from the polarization experiments (linear polarization (LPR) and PDP)) are presented in Table 4. In all cases, the carbon steel sample exhibited a higher polarization resistance (Rp), a lower corrosion rate (v), and a lower corrosion current density (icorr) in the acid solution containing the formulation and the commercial product than in their absence. Compared with the commercial corrosion inhibitor, which provides inhibition efficiency of 96.8% and 89.8%, the inventive formulation provided inhibition efficiency of 96.2% and 94% for carbon steel and Ni-Resist, respectively. The electrochemical results (Table 4) and the weight loss results (Table 3) are in agreement.

TABLE 4

Electrochemical parameters derived from LPR and PDP measurements for carbon steel and Ni-resist subject to 2 wt. % HCl solutions without corrosion inhibitor (blank), with 0.4 vol % commercial corrosion inhibitor, or with 0.4 vol % formulation

| | | | LPR | | | PDP | | |
|---|---|---|---|---|---|---|---|---|
| Alloy | Inhibitor | Time (h) | $R_p$ ($\Omega$ cm$^2$) | v (mm/yr) | $\eta_{LPR}$ (%) | $E_{corr}$ (mV vs Ag/AgCl) | $i_{corr}$ ($\mu$A cm$^{-2}$) | $\eta_{PDP}$ (%) |
| Carbon Steel | Blank | 24 | 43 ± 0.51 | 8.89 ± 0.001 | — | — | — | — |
| | | 72 | 104 ± 1.33 | 3.63 ± 0.001 | — | −506 | 177.60 | — |
| | Commercial | 24 | 936 ± 2.71 | 0.40 ± 0.002 | 95.5 | — | — | — |
| | | 72 | 1094 ± 1.93 | 0.40 ± 0.002 | 90.5 | −561 | 5.69 | 96.8 |
| | Formulation | 24 | 818 ± 0.71 | 0.35 ± 0.001 | 94.0 | — | — | — |
| | | 72 | 1080 ± 1.42 | 0.46 ± 0.003 | 89.6 | −601 | 6.71 | 96.2 |
| Ni-resist | Blank | 24 | 154 ± 4.95 | 0.38 ± 0.002 | — | — | — | — |
| | | 72 | 164 ± 4.24 | 1.79 ± 0.030 | — | −247 | 30.47 | — |
| | Commercial | 24 | 1245 ± 1.42 | 1.64 ± 0.030 | 90.5 | — | — | — |
| | | 72 | 1772 ± 3.54 | 0.17 ± 0.002 | 90.7 | −205 | 3.10 | 89.8 |
| | Formulation | 24 | 1156 ± 6.36 | 0.15 ± 0.001 | 89.4 | — | — | — |
| | | 72 | 2424 ± 1.42 | 0.19 ± 0.002 | 93.2 | −246 | 1.83 | 94.0 |

Figure 4C:
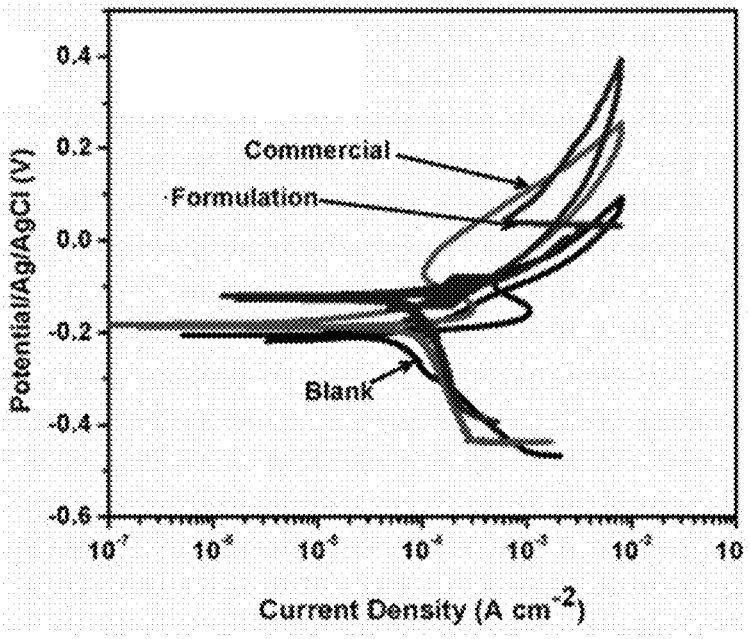

FIG. 4C shows the CPDP graphs obtained for 316L stainless steel. Four regions are identified: (i) active region, (ii) active-passive transition, (iii) passive region, and (iv) passive breakdown region. The values of the electrochemical parameters namely, corrosion potential (Ecorr), critical potential (Ecrit), passivation potential (Epass), and corrosion current density (icorr) derived from the analysis of the CPDP graphs are given in Table 5. By comparing the CPDP graph obtained in the presence of the inventive formulation and the commercial inhibitor, it is observed that the formulation has a lower capability to retard the active localized corrosion of the stainless steel and favor also its passivation.

TABLE 5

Electrochemical parameters derived from cyclic potentiodynamic polarization measurements for 316L stainless steel subject to 2 wt. % HCl solutions without corrosion inhibitor (blank), with 0.4 vol % commercial corrosion inhibitor, or with 0.4 vol % formulation after 72 h.

| System | $E_{corr}$ (mV vs Ag/AgCl) | $i_{corr}$ ($\mu$A cm$^{-2}$) | $E_{cri}$ (mV vs Ag/AgCl) | $E_{pass}$ (mV vs Ag/AgCl) | $\eta_{CPDP}$ (%) |
|---|---|---|---|---|---|
| Blank | −219 | 16.99 | −165 | −115 | — |
| Formulation | −187 | 7.13 | +73 | +85 | 58.0 |
| Commercial | −156 | 8.50 | −124 | −136 | 50.0 |

The invention claimed is:

1. A corrosion inhibitor composition, comprising:

a date palm leaves extract;

a benzimidazole compound having at least one a carbamate group;

a pyridine compound;

a thiourea compound;

a cinnamaldehyde compound;

a metal iodide;

urotropin; and a base fluid comprising an alcohol and an organic acid.

2. The corrosion inhibitor composition of claim 1, wherein the date palm leaves extract is an ethanolic date palm leaves extract.

3. The corrosion inhibitor composition of claim 2, wherein the ethanolic date palm leaves extract has a total phenolic content of 65 to 74 mg per g of the ethanolic date palm leaves extract, as determined by Folin-Ciocalteu assay.

4. The corrosion inhibitor composition of claim 1, wherein the date palm leaves extract is present in an amount of 0.1 to 10 wt. %, based on a total weight of the corrosion inhibitor composition.

5. The corrosion inhibitor composition of claim 1, wherein the benzimidazole compound is of formula (I) or a tautomer thereof (I)

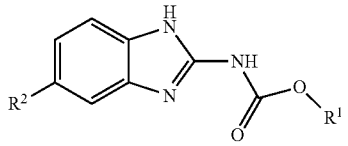

wherein:

$R^1$ is a an optionally substituted alkyl, an optionally substituted aryl, an optionally substituted arylalkyl, or an optionally substituted heterocyclyl; and $R^2$ is a hydrogen, an optionally substituted alkyl, an optionally substituted aryl, an optionally substituted arylalkyl, an optionally substituted heterocyclyl, an optionally substituted amide, a mercapto, an optionally substituted alkylthio, an optionally substituted arylthio, an optionally substituted alkoxy, a hydroxyl, a carboxy, a halo, an optionally substituted alkanoyloxy, an optionally substituted alkoxycarbonyl, an optionally substituted aroyl, or an optionally substituted alkanoylamino.

6. The corrosion inhibitor composition of claim 1, wherein the benzimidazole compound is present in an amount of 0.1 to 8 wt. %, based on a total weight of the corrosion inhibitor composition.

7. The corrosion inhibitor composition of claim 1, wherein the benzimidazole compound is present in an amount of 1 to 2 wt. %, based on a total weight of the corrosion inhibitor composition.

8. The corrosion inhibitor composition of claim 1, wherein the pyridine compound is of formula (II)

(II)

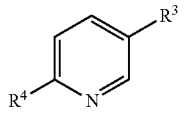

wherein:

$R^3$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, a halo, an optionally substituted alkoxycarbonyl, or an optionally substituted amino; and $R^4$ is a hydrogen, an optionally substituted alkyl, an optionally substituted aryl, an optionally substituted arylalkyl, an optionally substituted amide, a mercapto, an optionally substituted alkylthio, an optionally substituted alkoxy, a carboxy, an optionally substituted alkoxycarbonyl, or a formyl.

9. The corrosion inhibitor composition of claim 1, wherein the pyridine compound is present in an amount of 0.05 to 5 wt. %, based on a total weight of the corrosion inhibitor composition.

10. The corrosion inhibitor composition of claim 1, wherein the thiourea compound is of formula (III)

(III)

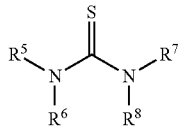

wherein:

$R^5$ and $R^7$ are independently a hydrogen, an optionally substituted alkyl, an optionally substituted aryl, or an optionally substituted arylalkyl, and $R^6$ and $R^8$ are independently a hydrogen, an optionally substituted alkyl, an optionally substituted aryl, or an optionally substituted arylalkyl, or wherein $R^6$ and $R^8$ together with the nitrogen atoms to which they are attached, form a 5- or 6-membered ring.

11. The corrosion inhibitor composition of claim 1, wherein the thiourea compound is present in an amount of 0.01 to 5 wt. %, based on a total weight of the corrosion inhibitor composition.

12. The corrosion inhibitor composition of claim 1, wherein the cinnamaldehyde compound is of formula (IV)

(IV)

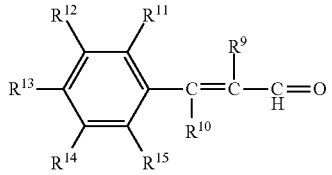

wherein:

$R^9$ and $R^{10}$ are independently hydrogen, an optionally substituted alkyl, an optionally substituted aryl, an optionally substituted alkoxy, or a halo, and $R^{11}$ to $R^{15}$ are independently hydrogen, an optionally substituted alkyl, an optionally substituted aryl, an optionally substituted alkoxy, an optionally substituted alkanoyl, an optionally substituted alkanoyloxy, a carboxy, an optionally substituted alkoxycarbonyl, a hydroxy, a halo, an optionally substituted amino, a nitro, a cyano, an optionally substituted alkylthio, or wherein two of these adjacent substituents represented by $R^{11}$, $R^{12}$, $R^{13}$, $R^{14}$ or $R^{15}$, together form a methylene dioxy group.

13. The corrosion inhibitor composition of claim 1, wherein the cinnamaldehyde compound is present in an amount of 0.001 to 2 wt. %, based on a total weight of the corrosion inhibitor composition.

14. The corrosion inhibitor composition of claim 1, wherein the metal iodide is sodium iodide, potassium iodide, or both.

15. The corrosion inhibitor composition of claim 1, wherein the metal iodide is present in an amount of 0.05 to 5 wt. %, based on a total weight of the corrosion inhibitor composition.

16. The corrosion inhibitor composition of claim 1, wherein the urotropin is present in an amount of 0.1 to 8 wt. %, based on a total weight of the corrosion inhibitor composition.

17. The corrosion inhibitor composition of claim 1, wherein the base fluid is present in an amount of 80 to 98 wt. %, based on a total weight of the corrosion inhibitor composition, and wherein a weight ratio of the organic acid to the alcohol is 5:1 to 50:1.

18. A method of inhibiting corrosion of metal during acid cleaning, the method comprising:

treating the metal with an acidic treatment fluid comprising 1 to 5 wt. % of an acid, based on a total weight of the acidic treatment fluid, and 0.1 to 5 vol. % of the corrosion inhibitor composition of claim 1, based on a total volume of the acidic treatment fluid.

19. The method of claim 18, wherein the metal is at least one ferrous metal selected from the group consisting of carbon steel, Ni-Resist, and stainless steel, and wherein the acid is at least one selected from the group consisting of hydrochloric acid, hydrofluoric acid, and sulfuric acid.

20. The method of claim 18, wherein the metal is treated with the acidic treatment fluid at a temperature of 40 to 70° C. to remove a buildup of scale on the metal.

* * * * *